US005836447A

United States Patent [19]

Garcia et al.

[11] Patent Number: 5,836,447

[45] Date of Patent: Nov. 17, 1998

[54] PACKAGING ASSEMBLY FOR SHIPPING A CONTAINER AND METHOD FOR USING SAME

[75] Inventors: Pedro F. Garcia, Atlanta, Ga.; Donald E. Weder, Highland, Ill.

[73] Assignee: Southpac Trust International, Inc.

[21] Appl. No.: 730,552

[22] Filed: Oct. 15, 1996

Related U.S. Application Data

[63] Continuation-in-part of Ser. No. 242,485, May 13, 1994, Pat. No. 5,564,567, which is a continuation-in-part of Ser. No. 202,058, Feb. 25, 1994, Pat. No. 5,411,137, which is a continuation of Ser. No. 93,109, Jul. 16, 1993, Pat. No. 5,311,992.

[51] Int. Cl.[6] ..... B65D 85/52

[52] U.S. Cl. ..... 206/423; 47/84; 53/397; 53/461; 206/460

[58] Field of Search ..... 206/423, 460, 206/813; 53/399, 397, 398, 461; 47/72, 84

[56] References Cited

U.S. PATENT DOCUMENTS

| | | | |
|---|---|---|---|
| 1,064,813 | 6/1913 | Bloomberg . | |
| 1,979,771 | 11/1934 | Potter | 47/41 |
| 2,165,539 | 7/1939 | Dahlgren | 206/80 |
| 2,209,778 | 7/1940 | Krasowski | 41/10 |
| 2,373,634 | 4/1945 | Wagner | 117/122 |
| 2,578,583 | 12/1951 | O'Brien | 206/65 |
| 2,612,989 | 10/1952 | Harrison | 206/45 |
| 2,664,670 | 1/1954 | Mulford | 47/37 |
| 2,707,352 | 5/1955 | Fischer | 47/58 |
| 2,744,624 | 5/1956 | Hoogstoel et al. | 206/65 |
| 2,774,187 | 12/1956 | Smithers | 47/41 |
| 2,871,080 | 1/1959 | Shelly | 312/107 |
| 3,022,605 | 2/1962 | Reynolds | 47/58 |
| 3,113,673 | 12/1963 | Stein | 206/65 |
| 3,389,784 | 6/1968 | Hendricks et al. | 206/47 |
| 3,431,706 | 3/1969 | Stuck | 53/390 |
| 3,488,022 | 1/1970 | Vittori | 248/152 |
| 3,513,895 | 5/1970 | Lattuca | 150/48 |
| 3,657,840 | 4/1972 | Benoist | 47/41 |
| 3,734,280 | 5/1973 | Amneus et al. | 206/65 |
| 3,869,828 | 3/1975 | Matsumoto | 47/34.11 |
| 3,883,990 | 5/1975 | Stidolph | 47/58 |
| 3,924,354 | 12/1975 | Gregoire | 47/34.11 |
| 3,962,503 | 6/1976 | Crawford | 428/40 |
| 4,053,049 | 10/1977 | Beauvais | 206/318 |
| 4,189,868 | 2/1980 | Tymchuck et al. | 47/84 |
| 4,216,620 | 8/1980 | Weder et al. | 47/72 |
| 4,248,347 | 2/1981 | Trimbee | 206/423 |
| 4,396,120 | 8/1983 | Morita | 206/460 |
| 4,400,910 | 8/1983 | Koudstaal et al. | 47/84 |
| 4,413,725 | 11/1983 | Bruno et al. | 206/45.33 |
| 4,470,508 | 9/1984 | Yen | 206/334 |
| 4,608,283 | 8/1986 | White | 428/4 |
| 4,621,733 | 11/1986 | Harris | 206/423 |

(List continued on next page.)

FOREIGN PATENT DOCUMENTS

| | | |
|---|---|---|
| 192843 | 11/1957 | Austria . |
| 0050990 | 5/1982 | European Pat. Off. . |
| 1393725 | 2/1965 | France . |
| 2137325 | 12/1972 | France . |
| 2221936 | 10/1974 | France . |
| 2467796 | 11/1979 | France . |
| 2619698 | 8/1987 | France . |
| 8905250 | 10/1989 | Germany . |
| 4352664 | 12/1992 | Japan . |
| 8101464 | 10/1982 | Netherlands . |
| 560532 | 4/1975 | Switzerland . |
| 26878 | 11/1913 | United Kingdom . |

*Primary Examiner*—Jim Foster
*Attorney, Agent, or Firm*—Dunlap, Codding & Rogers, P.C.

[57] ABSTRACT

A packaging assembly for shipping a container. A support member supports the container in an upright position. A sheet of material is wrapped about the support member and at least a portion of the container such that the sheet of material encompasses the support member and at least a portion of the container. The sheet of material may be secured about the support member and at least a portion of the container. The container may be bondingly secured to the support member.

36 Claims, 7 Drawing Sheets

U.S. PATENT DOCUMENTS

| | | | |
|---|---|---|---|
| 4,640,079 | 2/1987 | Stuck | 53/390 |
| 4,646,470 | 3/1987 | Maggio | 47/76 |
| 4,733,521 | 3/1988 | Weder et al. | 53/580 |
| 4,741,440 | 5/1988 | Harris | 206/423 |
| 4,773,182 | 9/1988 | Weder et al. | 47/72 |
| 4,801,014 | 1/1989 | Meadows | 206/423 |
| 4,819,803 | 4/1989 | Neiser | 206/423 |
| 4,835,834 | 6/1989 | Weder | 29/525 |
| 4,882,893 | 11/1989 | Spencer et al. | 53/449 |
| 4,980,209 | 12/1990 | Hill | 428/34.1 |
| 5,092,465 | 3/1992 | Weder et al. | 206/423 |
| 5,105,599 | 4/1992 | Weder | 53/399 |
| 5,148,918 | 9/1992 | Weder et al. | 206/423 |
| 5,195,637 | 3/1993 | Weder | 206/423 |
| 5,199,242 | 4/1993 | Weder et al. | 53/397 |
| 5,235,782 | 8/1993 | Landau | 47/72 |
| 5,239,775 | 8/1993 | Landau | 47/72 |
| 5,240,109 | 8/1993 | Weder et al. | 206/423 |
| 5,255,784 | 10/1993 | Weder et al. | 206/423 |
| 5,265,727 | 11/1993 | Anderson | 206/457 |
| 5,311,992 | 5/1994 | Weder et al. | 206/423 |
| 5,407,072 | 4/1995 | Weder et al. | 206/423 |
| 5,411,137 | 5/1995 | Weder et al. | 206/423 |
| 5,564,567 | 10/1996 | Weder | 206/423 |

PACKAGING ASSEMBLY FOR SHIPPING A CONTAINER AND METHOD FOR USING SAME

CROSS-REFERENCE TO RELATED APPLICATIONS

This application is a continuation-in-part of U.S. Ser. No. 08/242,485, filed May 13, 1994, entitled "METHOD FOR TRANSPORTING FLORAL GROUPINGS now U.S. Pat. No. 5,564,567"; which is a continuation-in-part of U.S. Ser. No. 08/202,058, filed Feb. 25, 1994, entitled "RETAINING FLAP FOR SHIPPING CARTONS", now U.S. Pat. No. 5,411,137; which is a continuation of U.S. Ser. No. 08/093,109, filed Jul. 16, 1993, entitled "RETAINING FLAP FOR SHIPPING CARTONS", now U.S. Pat. No. 5,311,992.

STATEMENT REGARDING FEDERALLY SPONSORED RESEARCH OR DEVELOPMENT

Not applicable.

BACKGROUND OF THE INVENTION

1. Field of the Invention

The present invention relates to a packaging assembly and more particularly, but not by way of limitation, to a packaging assembly for shipping a container and method of assembling same wherein the container is disposed upon a support member and a sheet of material is wrapped about the support member and the container such that the sheet of material encompasses the support member and at least a portion of the container.

In another aspect, the invention relates to a packaging assembly for shipping a container and method of assembling same wherein the container is disposed upon a support member and a sheet of material is wrapped about the support member and the container such that the sheet of material encompasses the support member and at least a portion of the container and wherein sheet extension is disposed about at least a portion of the container so as to provide an item receiving cavity.

2. Brief Description of the Prior Art

Not applicable.

BRIEF SUMMARY OF THE INVENTION

Not applicable.

DETAILED DESCRIPTION OF THE INVENTION

Definitions

Figure 1:
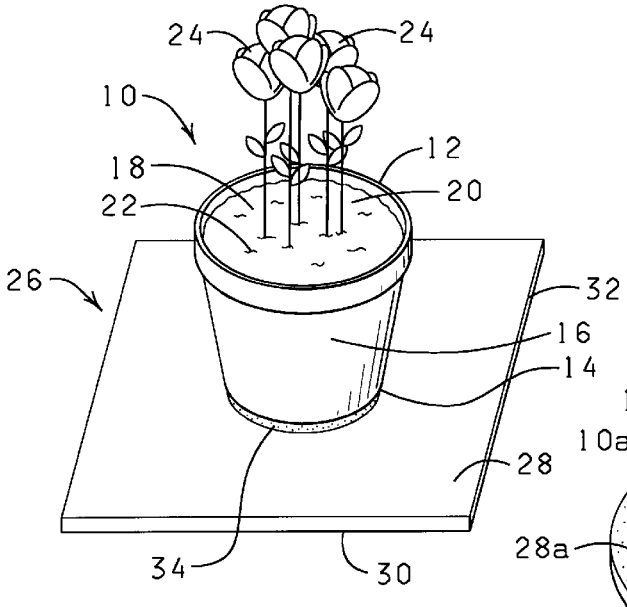
FIG. 1 is a pictorial representation of a flower pot having a bonding material thereon disposed on a support member wherein the flower pot has a growing medium disposed therein for supporting a plurality of flowers.

The term "container" as used herein is to be understood to mean a container such as a bowl, a vase, a wine bottle, a box, or a flower pot which can be used for supporting floral arrangements, including but not limited to potted plants, cut flowers, dried materials, silk flowers and other artificial flowers, and decorations.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. Further, the floral grouping may comprise a growing potted plant having a root portion as well. However, it will be appreciated that the floral grouping may consist of only a single bloom or only foliage, or a botanical item (not shown), or a propagule. The term "floral grouping" may be used interchangeably herein with the term "floral arrangement".

The term "pot" or "flower pot" as used herein is to be understood to mean a container which can be used for supporting floral groupings including but not limited to cut flowers, dried materials, silk flowers and other artificial flowers, and decorations. The term "pot" or "flower pot" as used herein also refers to any type of container for holding a plant, or another pot type container. Examples of flower pots and/or pot type containers include, but are not limited to, clay pots, wooden pots, plastic pots, pots made from natural and/or synthetic fibers, or any combination thereof. Such flower pots and or pot-type containers are provided with a retaining space for receiving a floral grouping. The floral grouping may be disposed within the retaining space of the flower pot with a suitable growing medium, or other retaining medium, such as a floral foam. It will also be understood that in some cases the floral grouping, and any appropriate growing medium or other retaining medium, may be disposed in a sleeve formed from a sheet of material having a three dimensional pattern printed thereon if the sleeve is adapted to contain a medium.

The term "bonding material" when used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer which may be applied to the sheet of material and, in this instance, heat, sound waves, or vibrations, also must be applied to effect the sealing.

The term "bonding material" when used herein also means any type of material or thing which can be used to effect the bonding or connecting of the two adjacent portions of the material or sheet of material to effect the connection or bonding described herein. The term "bonding material" also includes ties, labels, bands, ribbons, strings, tape, staples or combinations thereof. Some of the bonding materials would secure the ends of the material while other bonding material may bind the circumference of the wrapper. Another way to secure the wrapping is to heat seal the ends of the material to another portion of the material. One way to do this is to contact the ends with an iron of sufficient heat to heat seal the material.

The term "bonding material" when used herein also means any heat or chemically shrinkable material, and static electrical or other electrical means, magnetic means, mechanical or barb-type fastening means or clamps, curl-type characteristics of the film or materials incorporated in the sheet of material which can cause the material to take on certain shapes, and any type of welding method which may weld portions of the sheet to itself.

The term "polymer film" when used herein means synthetic polymers such as a polypropylene or naturally occurring polymers such as cellophane. A polymer film is relatively strong and not as subject to tearing (substantially non-tearable), as might be the case with paper or foil.

The term "cling wrap or material" when used herein means any material which is capable of connecting to the sheet of material and/or itself upon contacting engagement during the wrapping process and is wrappable about an item whereby portions of the cling material contactingly engage and connect to other portions of another material or, alternatively, itself, for generally securing the material wrapped about at least a portion of a flower pot. This connecting engagement is preferably temporary in that the material may be easily removed, i.e., the cling material "clings" to the flower pot.

EMBODIMENT OF FIGS. 1–6

Referring to FIG. 1, shown therein and designated by the general reference numeral 10 is a flower pot having an upper end 12, a lower end 14 and an outer peripheral surface 16 extending between the upper end 12 and the lower end 14. The flower pot 10 has an internal cavity 18 accessible via an opening 20 in the upper end 12 of the flower pot 10. The flower pot 10 is provided with a growing medium 22 and a plurality of flowers 24 disposed within the internal cavity 18 of the flower pot 10. The flowers 24 are supported by the growing medium 22 so that the flowers 24 extend a distance from the upper end 12 of the flower pot 10.

To provide greater stability to the flower pot 10, the flower pot 10 is disposed on a support member 26. The support member 26 has an upper support surface 28, a lower surface 30, and a periphery 32. The support member 26 is dimensioned so that the periphery 32 of the support member 26 extends a distance beyond the outer peripheral surface 16 of the flower pot 10 on all sides thereof. It should be understood that the support member 26 may be provided with any shape, whether geometric, non-geometric, asymmetrical and/or fanciful as long as it functions in accordance with the present invention. The support member 26 may be, by way of example but not by way of limitation, rectangular, circular, hollow, combinations thereof, or any other shape, as long as the support member 26 functions as described herein as noted above.

The lower end 14 of the flower pot 10 is disposed on the upper support surface 28 of the support member 26 such that the flower pot 10 is supported on the upper support surface 28 of the support member 26 in a substantially upright orientation. The lower end 14 of the flower pot 10 has a bonding material 34 thereon for securing the lower end 14 of the flower pot 10 to the upper support surface 28 of the support member 26.

While the flower pot 10 has been described as having the bonding material 34 disposed on the lower end 14 thereof for securing the flower pot 10 on the upper support surface 28 of the support member 26, it should be understood that the flower pot 10 may be secured to the upper support surface 28 of the support member 26 by any means capable of retaining the flower pot 10 in a substantially upright position on the support member 26.

Also, while the flower pot 10 has been depicted in combination with the support member 26, it should be understood that any container capable of functioning in the manner as the flower pot 10 can be employed. The flower pot 10 may be any container provided with any shape whether geometric, non-geometric, asymmetrical and/or fanciful, as long as it functions in accordance with the present invention. The container may be, by way of example but not by way of limitation, frusto-conical, cylindrical, a combination of both frusto-conical and cylindrical, or any other shape, as long as the flower pot 10 functions as described herein as noted above.

The flower pot 10 is preferably positioned near the center of the support member 26 to provide the flower pot 10 with the greatest stability. However, it should be understood that the flower pot 10 may be positioned in a noncentral location on the support member 26 for aesthetic and functional purposes.

The support member 26 may be provided with a bonding material (not shown) for securing the flower pot 10 to the support member 26 thereby providing additional stability to the flower pot 10. The support member 26 may also be provided with a recessed portion (not shown) adapted to receive at least a portion of the flower pot 10 thereby defining the location for placement of the flower pot 10 on the support member 26 and/or frictionally engaging the flower pot 10 with the support member 26. Although not shown, the support member 26 may be provided with an inner cavity for supporting other items in addition to the flower pot 10.

The bonding material 34, as previously described, is preferably a pressure sensitive adhesive. Such use of adhesives, and particularly pressure sensitive adhesives, is taught in U.S. Pat. No. 5,111,638, entitled, "Method for Wrapping An Object with a Material Having Pressure Sensitive Adhesive Thereon," which is hereby incorporated by reference herein. The bonding material 34 may comprise varying bonding characteristics when disposed on certain portions of the flower pot 10 and/or the sheet of material 38 (see FIG. 4). Further, the bonding material 34 may also comprise at least one color derived from dye, ink, and/or pigment as previously described herein. Bonding materials 34 as described above, are known in the art and commercially available.

Figure 2:
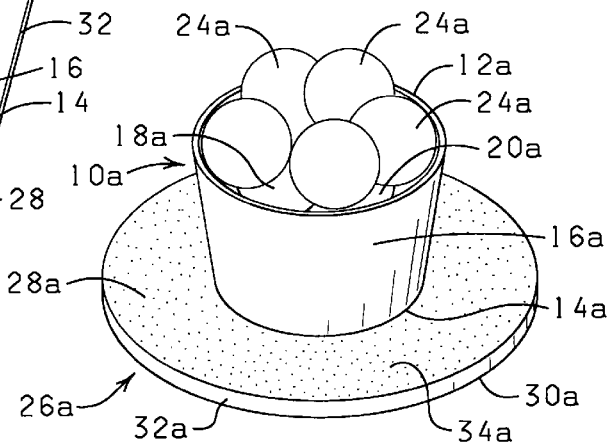
FIG. 2 is pictorial representation of a bowl disposed on a support member, the support member having a bonding material thereon for stabilizing the bowl, the bowl having a plurality of fruit therein.

FIG. 2 shows a bowl 10*a* having an upper end 12*a*, a lower end 14*a* and an outer peripheral surface 16*a* extending between the upper end 12*a* and the lower end 14*a*. The bowl 10*a* has an internal cavity 18*a* accessible via an opening 20*a* in the upper end 12*a* of the bowl 10*a*. The bowl 10*a* is provided with a plurality of fruit 24*a* disposed in the internal cavity 18*a* of the bowl 10*a* substantially as shown.

The bowl 10*a* is disposed on a support member 26*a* having an upper support surface 28*a*, a lower support surface 30*a*, and a circular periphery 32*a* extending a distance beyond the outer peripheral surface 16*a* of the bowl 10*a* on all sides thereof. The lower end 14*a* of the bowl 10*a* is disposed substantially adjacent the upper support surface 28*a* of the support member 26*a* such that the bowl 10*a* is supported on the upper support surface 28*a* of the support member 26*a* in a substantially upright orientation. The upper support surface 28*a* of the support member 26*a* has a bonding material 34*a* thereon for securing the lower end 14*a* of the bowl 10*a* to the upper support surface 28*a* of the support member 26*a*.

Figure 3:
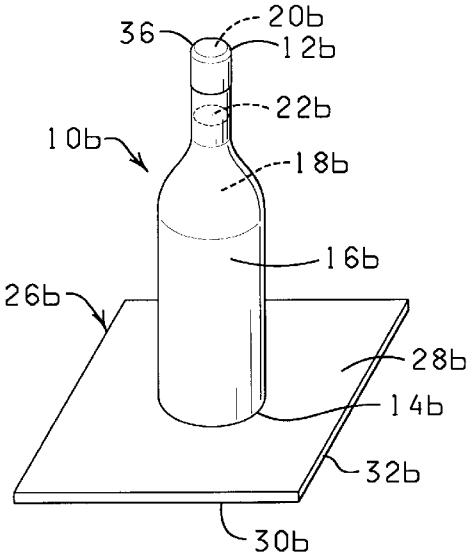
FIG. 3 is a pictorial representation of a bottle disposed on a support member.

FIG. 3 shows a bottle 10*b* having an upper end 12*b*, a lower end 14*b* and an outer peripheral surface 16*b* extending between the upper end 12*b* and the lower end 14*b*. The bottle 10*b* has an internal cavity 18*b* accessible via an opening 20*b* in the upper end 12*b* of the bottle 10*b*. The bottle 10*b* is a container provided with a liquid 22*b* such as wine disposed within the internal cavity 18*b* and sealed therein by a cap 36 disposed on the upper end 12*b* of the bottle 10*b*.

The bottle 10*b* is disposed on a support member 26*b* having an upper support surface 28*b*, a lower surface 30*b*, and a periphery 32*b* extending a distance beyond the outer peripheral surface 16*b* of the bottle 10*b* on all sides thereof. The lower end 14*b* of the bottle 10*b* is disposed substantially adjacent the upper support surface 28*b* of the support member 26*b* such that the bottle 10*b* is supported on the upper support surface 28*b* of the support member 26*b* in a substantially upright orientation.

Figure 4:
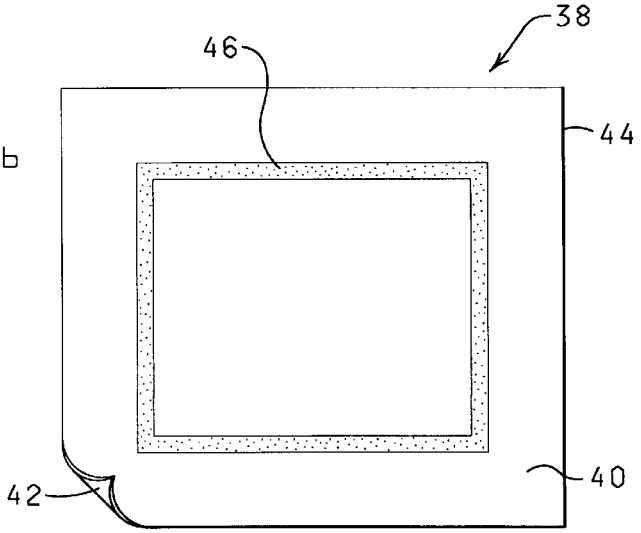
FIG. 4 is a pictorial representation of a sheet of material having a bonding material thereon, the sheet of material disposable about a support member and at least a portion of a flower pot so as to provide a packaging assembly for shipping a flower pot constructed in accordance with the present invention.

Referring to FIG. 4, shown therein and designated by the general reference numeral 38 is a sheet of material having a top side 40, a bottom side 42, and a periphery 44. A bonding material 46 is disposed on a portion of the top side 40 of the sheet of material 38, preferably a distance from the periphery 44 of the sheet of material 38.

While the sheet of material 38 has been depicted as a generally flat, rectangular sheet of material, it should be understood that the sheet of material 38 may be provided with any shape, whether geometric, non-geometric, asymmetrical and/or fanciful as long as it functions in accordance with the present invention. The sheet of material 38 may be, by way of example but not by way of limitation, circular, conical, combinations thereof, or any other shape, as long as the sheet of material 38 functions as described herein as noted above.

The sheet of material 38 may also be provided with side ventilation holes (not shown), or the sheet of material 38 can be made from gas permeable or impermeable materials. When multiple sheets of material are used together, they may be connected together or laminated, or may comprise separate layers. Finally, it will be appreciated that the sheet of material 38 may be substantially flat or angled such that when disposed about the flower pot 10 and the support member 26 or any other container supported on the support member 26, the sheet of material 38 may extend a distance upwardly and outwardly from the flower pot 10. Any thickness of the sheet of material 38 may be utilized in accordance with the present invention as long as the sheet of material 38 may be disposed about a flower pot 10 as described herein. Typically the sheet of material 38 has a thickness range of from about 0.1 mils to about 30 mils. The sheet of material 38 may be constructed from one sheet of polymer film having a thickness in a range of from about 0.5 mils to about 2.5 mils. In an alternate embodiment, the sheet of material 38 may be constructed from polymer film having a thickness in a range of from about 0.2 mils to about 10 mils.

The sheet of material 38 is constructed from any suitable material that is capable of being disposed about a container such as a flower pot 10. Examples of material suitable for use are paper (untreated or treated in any manner), cellophane, foil, polymer film, fiber (woven or non-woven or synthetic or natural), cloth (woven or non-woven or natural or synthetic) burlap, or any combination thereof.

The sheet of material 38 may also be constructed in whole or in part, from a cling material or polymer film. The cling material is constructed and treated if necessary from polyethylene such as Cling Wrap made by Glad®, First Brands Corporation, Danbury, Conn. The thickness of the cling material will, in part, depend upon the size of the sheet of material 38 and the size of the container wrapped within the sheet of material 38, i.e., generally, a larger flower pot may require a thicker and therefore stronger cling material. The cling material will range in thickness from about 0.1 mils to about 10 mils, and preferably from about 0.5 mils to about 2.5 mils and most preferably from about 0.6 to about 2 mils.

The sheet of material 38 may vary in color. Further, the sheet of material 38 may consist of designs which are printed, etched, and/or embossed; in addition, the sheet of material 38 may have various colorings, coatings, flockings, and/or metallic finishes, or be characterized totally or partially by pearlescent, translucent, transparent, iridescent, or the like characteristics. Each of the above-named characteristics may occur alone or in combination. Moreover, each surface of the sheet of material 38 may vary in the combinations of such characteristics.

The sheet of material 38 may also be constructed from one or more sheets of polypropylene film or combination of one or more sheets of polypropylene films and a sheet of foil wherein at least a lower or outer surface may be provided with a three dimensional pattern printed thereon, a printed pattern, an embossed pattern and combinations thereof. The sheets of material employed to produce the sheet of material 38 may be connected together or laminated or may be separate layers. In an alternative embodiment, the sheet of material 38 may be constructed from only one sheet of polypropylene film.

The bonding material 46 disposed on the sheet of material 38 may be any securing assembly capable of securing the sheet of material 38 about the flower pot 10 as will be described hereinafter in detail. It should be understood that the bonding material 46 is disposable on at least a portion of at least one side the sheet of material 38 such that the sheet of material 38 functions in accordance with the present invention.

Figure 5:
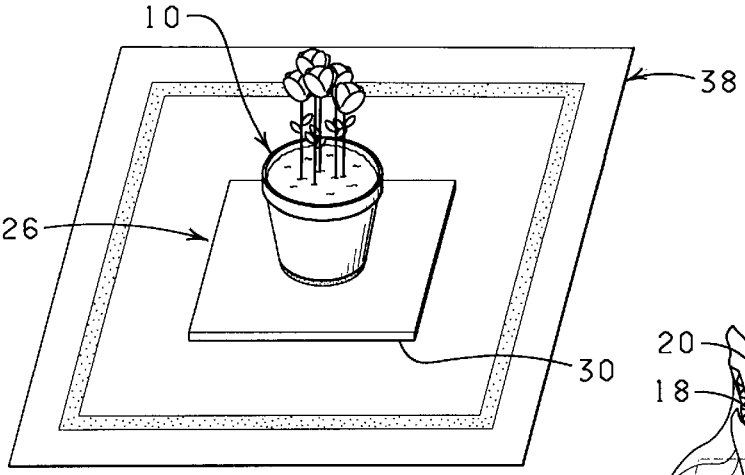
FIG. 5 is a pictorial representation of the flower pot and support member of FIG. 1 positioned on the sheet of material of FIG. 4 such that a lower surface of the support member is disposed adjacent the sheet of material.

Shown in FIG. 5, the support member 26 and the flower pot 10 of FIG. 1 are positioned on the sheet of material 38 of FIG. 4 such that the sheet of material 38 is disposed substantially adjacent the lower surface 30 of the support member 26. Thereafter, the sheet of material 38 is wrapped about the support member 26 and a portion of the flower pot 10 to provide a packaging assembly 48 substantially as shown in FIG. 6.

Figure 6:
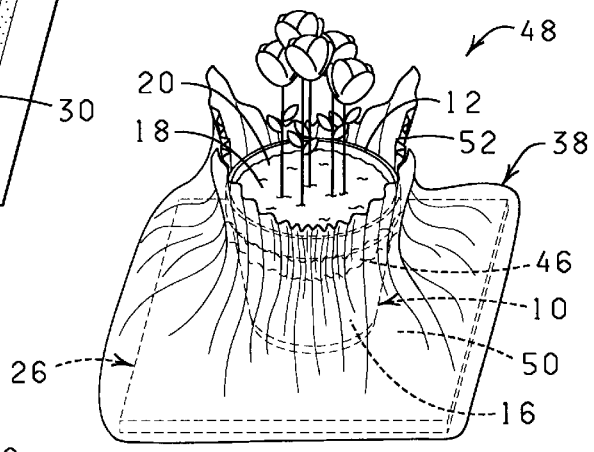
FIG. 6 is a pictorial representation of a packaging assembly for shipping a flower pot wherein the sheet of material of FIG. 4 is disposed about the support member and a portion of the flower pot of FIG. 1 and bondingly secured to an outer peripheral surface of the flower pot so as to provide a packaging assembly for shipping a flower pot in accordance with the present invention.

Referring now to FIG. 6, a portion of the sheet of material 38 is disposed about a portion of the flower pot 10 such that the sheet of material 38 encompasses the support member 26 and a portion of the flower pot 10. The sheet of material 38 is disposed about the support member 26 and the flower pot 10 such that a storage cavity 50 is formed between the support member 26, the flower pot 10, and the sheet of material 38. The sheet of material 38 is gathered about the outer peripheral surface 16 of the flower pot 10 thereby forming a plurality of gathered portions 52. The gathered portions 52 of the sheet of material 38 are then secured to the outer peripheral surface 16 of the flower pot 10 via the bonding material 46. The gathered portions 52 of the sheet of material 38 are disposed about the flower pot 10 such that the upper end 12 of the flower pot 10 remains substantially uncovered thereby providing access to the internal cavity 18 of the flower pot 10 via the opening 20 in the upper end 12 of the flower pot 10.

The sheet of material 38 has been depicted as being disposed about the support member 26 and at least a portion of the flower pot 10 such that the sheet of material 38 is disposed about at least a portion of the outer peripheral surface 16 of the flower pot 10 thereby encircling at least a portion of the flower pot 10. It should be understood that the sheet of material 38 may be disposed about the support member 26 and the flower pot 10 such that the sheet of material 38 is disposed above the upper end 12 of the flower pot 10 whereby the upper end 12 of the flower pot 10 remains substantially uncovered by the sheet of material 38 thereby providing access to the internal cavity 18 of the flower pot 10. The size and dimensions of the storage cavity 50 are determined by the position of the sheet of material 38 about the flower pot 10 and the tension placed on the sheet of material 38. The sheet of material 38 may be positioned about the flower pot 10 such that the sheet of material 38 forms the storage cavity 50 sized to receive a predetermined number of items. The sheet of material 38 may be, but not by way of limitation, gathered, crimped, stretched, positioned, or otherwise disposed about the flower pot 10.

The bonding material 46 may be a securing assembly, previously described, disposable about one of at least a portion of the flower pot 10, at least a portion of the sheet of material 38, and combinations thereof for securing one of at least a portion of the sheet of material 38 about at least a portion of the flower pot 10, at least a portion of at least one gathered portion 52 in the gathered position, and combinations thereof. It should be understood that the bonding material 46 may be any means capable of securing the sheet of material 38 about the flower pot 10. Depending on the size and shape of the sheet of material 38, the sheet of material 38 may be, but not by way of limitation, banded, tied, crimped, bonded, heat sealed, or otherwise secured about the flower pot 10. It should be understood that when employing certain materials such as foil for the sheet of material 38, the sheet of material 38 may be gathered to form gathered portions 52 thereby conforming the sheet of material 38 about the flower pot 10 without the aid of a bonding material 46. It should be understood that the sheet of material 38 may be secured about the flower pot 10 such that the sheet of material 38 holds the flower pot 10 in the substantially upright position without the use of additional bonding material 46.

EMBODIMENT OF FIGS. 7–10

Figure 7:
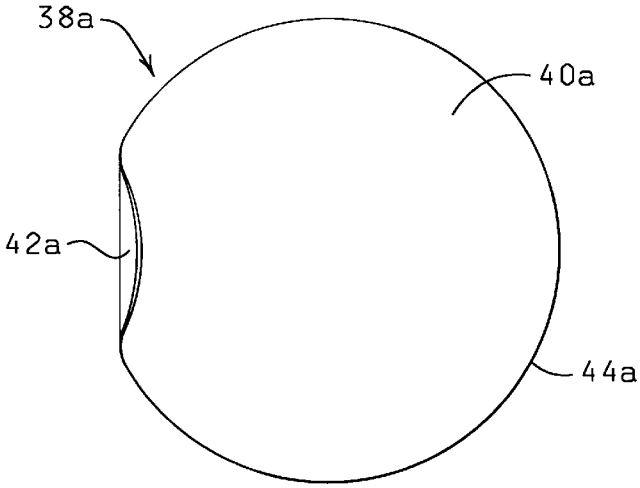
FIG. 7 is a pictorial representation of a sheet of material disposable about a support member and at least a portion of a bowl so as to provide a packaging assembly for shipping a bowl constructed in accordance with the present invention.

Referring to FIG. 7 and designated by the general reference numeral 38*a* is a sheet of material having a top side 40*a*, a bottom side 42*a*, and a periphery 44*a*.

Figure 8:
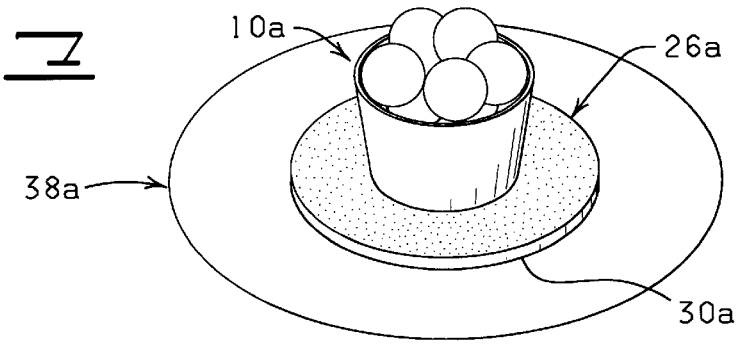
FIG. 8 is a pictorial representation of the bowl and support member of FIG. 2 positioned on the sheet of material of FIG. 7 such that a lower surface of the support member is disposed adjacent the sheet of material.

Shown in FIG. 8, the support member 26*a* and the bowl 10*a* of FIG. 2 are positioned on the sheet of material 38*a* of FIG. 7 such that the sheet of material 38*a* is disposed substantially adjacent the lower surface 30*a* of the support member 26*a*. Thereafter, the sheet of material 38 is wrapped about the support member 26*a* and the bowl 10*a* to provide a packaging assembly 48*a* substantially as shown in FIG. 9.

Figure 9:
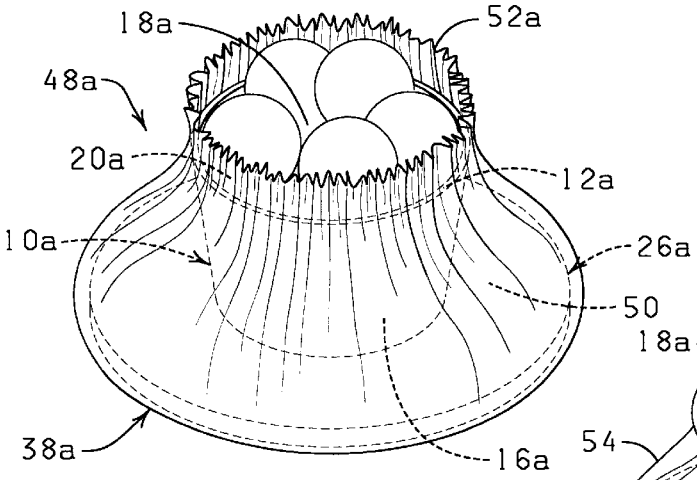
FIG. 9 is a pictorial representation of another embodiment of a packaging assembly wherein the sheet of material of FIG. 7 is disposed about the support member and a portion of the bowl of FIG. 2 and a portion of the sheet of material is crimped about an upper end of the bowl and thereby secured adjacent the an upper end of the bowl so as to provide a packaging assembly for shipping a bowl in accordance with the present invention.

Referring now to FIG. 9, a portion of the sheet of material 38*a* is disposed about a portion of the bowl 10*a* such that the sheet of material 38*a* encompasses the support member 26*a* and a portion of the bowl 10*a*. The sheet of material 38*a* is disposed about the support member 26*a* and the bowl 10*a* such that a storage cavity 50*a* is formed between the support member 26*a*, the bowl 10*a*, and the sheet of material 38*a*. The sheet of material 38*a* is crimped adjacent the upper end 12*a* of the bowl 10*a* thereby forming a plurality of crimped portions 52*a*. The crimped portions 52*a* of the sheet of material 38*a* are secured adjacent the outer peripheral surface 16*a* of the bowl 10*a* via the crimped portions 52*a*. The crimped portions 52*a* of the sheet of material 38*a* are disposed about the bowl 10*a* such that the upper end 12*a* of the bowl 10*a* remains substantially uncovered thereby providing access to the internal cavity 18*a* of the bowl 10*a* via the opening 20*a* in the upper end 12*a* of the bowl 10*a*.

The sheet of material 38*a* has been depicted as being disposable about the support member 26*a* and the bowl 10*a* such that the sheet of material 38*a* is disposed adjacent the upper end 12*a* of the bowl 10*a* thereby encompassing the support member 26*a* and a substantial portion of the bowl 10*a* remains substantially uncovered by the sheet of material 38*a* thereby providing access to the internal cavity 18*a* of the bowl 10*a*. It should be understood that the sheet of material 38*a* may also be disposed about the support member 26*a* and at least a portion of the bowl 10*a* such that the sheet of material 38*a* is disposed about at least a portion of the outer peripheral surface 16*a* of the bowl 10*a* thereby encircling at least a portion of the bowl 10*a*. The size and dimensions of the storage cavity 50*a* are determined by the position of the sheet of material 38*a* about the bowl 10*a* and the tension placed on the sheet of material 38*a*. The sheet of material 38*a* may be positioned about the bowl 10*a* such that the sheet of material 38*a* forms a storage cavity 40*a* sized to receive a predetermined number of items. The sheet of material 38*a* may be, but not by way of limitation, gathered, crimped, stretched, positioned, or otherwise disposed about the bowl 10*a*.

Figure 10:
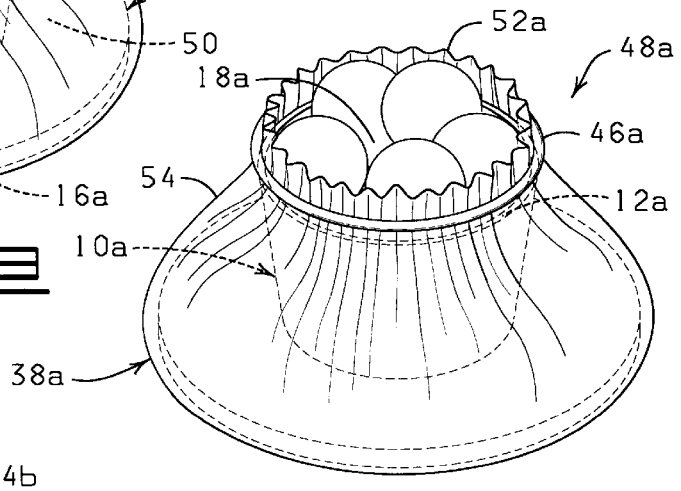
FIG. 10 is a pictorial representation of the packaging assembly of FIG. 9 wherein the crimped portion of the sheet of material disposed about the support member and a portion of the bowl is secured via a band so as to provide a packaging assembly for shipping a bowl in accordance with the present invention.

FIG. 10 shows the packaging assembly 48*a* of FIG. 9 provided with a band 46*a* disposed about a portion of the sheet of material 38*a*. The band 46*a* is disposed about the crimped portions 52*a* of the sheet of material 38*a* thereby securing a portion of the sheet of material 38*a* adjacent the upper end 12*a* of the bowl 10*a* such that the upper end 12*a* of the bowl 10*a* remains substantially uncovered thereby providing access to the internal cavity 18*a* of the bowl 10*a*. The band 46*a* also secures the crimped portions 52*a* in the crimped position adjacent the upper end 12*a* of the bowl 10*a*.

While the band 46*a* has been depicted for securing the sheet of material 38*a* substantially adjacent the upper end 12*a* of the bowl 10*a* via the crimped portions 52*a*, it should be understood that the band 46*a* can also be positioned about an uncrimped portion 54 of the sheet 38*a*. Further, more than one of the bands 46*a* can be employed. As stated previously, it should be understood that while the band 46*a* has been illustrated for securing the sheet of material 38*a* about the bowl 10*a* and the support member 26*a*, any other suitable means capable of securing the sheet of material 38*a* about the bowl 10*a* can be employed in accordance with the present invention. For example, depending on the size and shape of the sheet of material 38*a*, the sheet of material 38*a* may be, but not by way of limitation, banded, tied, crimped, bonded, heat sealed, or otherwise secured about the support member 26*a* and the bowl 10*a*. It should be understood that when employing certain materials such as foil for the sheet of material 38*a*, the sheet of material 38*a* may be gathered to form crimped portions 52*a* thereby conforming the sheet of material 38*a* about the bowl 10*a* without the aid of a band 46*a* or any other securing means. However, the sheet of material 38*a* is desirably secured about the bowl 10*a* and the support member 26*a* such that the sheet of material 38*a* holds the bowl 10*a* in the substantially upright position, on the support member 26*a*.

EMBODIMENT OF FIGS. 11–12

Figure 11:
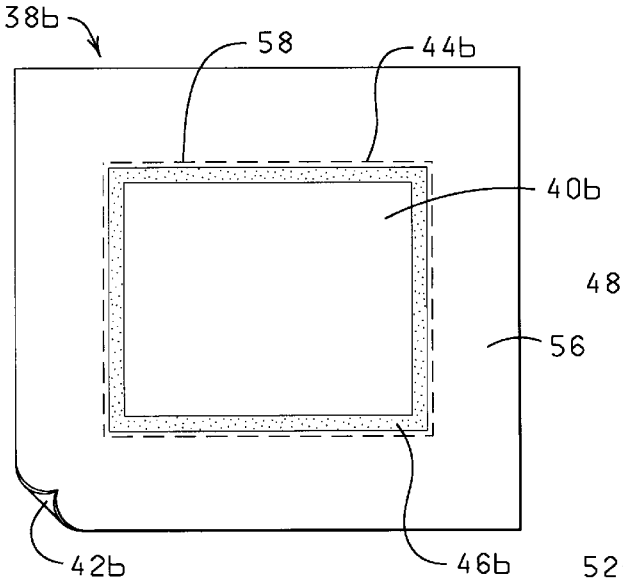
FIG. 11 is a pictorial representation of another embodiment of a sheet of material having a bonding material thereon and a detachable sheet extension, the sheet of material and the sheet extension disposable about a support member and at least a portion of a flower pot so as to provide a packaging assembly for shipping a flower pot in accordance with the present invention.

Referring to FIG. 11 and designated by the general reference numeral 38*b* is a sheet of material having a top side 40*b*, a bottom side 42*b*, a periphery 44*b*, a sheet extension 56 extending a distance beyond the periphery 44*b*, and a plurality of perforations 58 disposed between the sheet extension 56 and the periphery 44*b*. The sheet extension 56 is a generally flat sheet of material formed integrally with the sheet of material 38*b* thereby forming a larger rectangular sheet of material. A bonding material 46*b* is disposed upon a portion of the top side 40*b* of the sheet of material 38*b*, preferably a distance from the periphery 44*b*.

Figure 12:
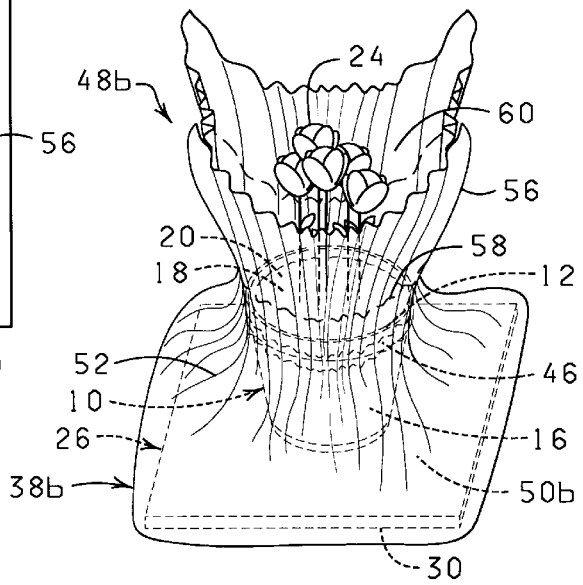
FIG. 12 is a pictorial representation of a packaging assembly for shipping a container wherein the sheet of material of FIG. 11 is disposed about the support member and flower pot of FIG. 1 and bondingly secured to the outer peripheral surface of the flower pot, the sheet extension extending a distance above an upper end of the flower pot thereby defining an item receiving cavity so as to provide a packaging assembly for shipping the flower pot in accordance with the present invention.

Shown in FIG. 12, the support member 26 and the flower pot 10 of FIG. 1 are positioned on the sheet of material 38*b* of FIG. 11 such that the sheet of material 38*b* is disposed substantially adjacent the lower surface 30 of the support member 26. Thereafter, the sheet of material 38*b* is wrapped about the support member 26 and a portion of the flower pot 10 to provide a packaging assembly 48*b* substantially as shown. A portion of the sheet of material 38*b* is disposed about a portion of the flower pot 10 such that the sheet of material 38*b* encompasses the support member 26 and a portion of the flower pot 10. The sheet of material 38*b* is disposed about the support member 26 and the flower pot 10 such that a storage cavity 50*b* is formed between the support member 26, the flower pot 10, and the sheet of material 38*b*. The sheet of material 38*b* is gathered about the outer peripheral surface 16 of the flower pot 10 thereby forming a plurality of gathered portions 52*b*. The gathered portions 52*b* of the sheet of material 38*b* are secured to the outer peripheral surface 16 of the flower pot 10 via the bonding material 46*b* disposed on a portion of the sheet of material 38*b*. The sheet extension 56 is disposed about a portion of the container and extended a distance from the flower pot 10 such that the upper end 12 of the flower pot 10 remains substantially uncovered thereby providing access to the internal cavity 18 of the flower pot 10 via opening 20 in the upper end 12 of the flower pot 10. Thus, the sheet extension 56 encompasses a portion of the flowers 24 extending a distance above the flower pot 10 and defines an item receiving cavity 60 capable of receiving a predetermined number of items. The sheet extension 56 is detachable from the sheet of material 38*b* along the plurality of perforations 58.

The sheet extension 56 has been depicted as being disposed about a portion of the flower pot 10 such that the sheet extension 56 is disposed about at least a portion of the outer peripheral surface 16 of the flower pot 10 thereby encircling at least a portion of the flower pot 10. It should be understood that the sheet of material 38*b* may be of a sufficient size so that when the sheet of material 38*b* is wrapped about the flower pot 10 and the support member 26, the sheet extension 56 is disposed above the upper end 12 of the flower pot 10. The sheet extension 56 may be, but not by way of limitation, gathered, crimped, stretched, positioned, or otherwise disposed about the flower pot 10 and the support member 26.

While the sheet extension 56 has been depicted as a generally flat, rectangular sheet of material, it should be understood that the sheet extension 56 may be provided with any shape, whether geometric, non-geometric, asymmetrical and/or fanciful as long as it functions in accordance with the present invention. The sheet extension 56 may be, by way of example, but not by way of limitation, circular, conical, combinations thereof, or any other shape, as long as the sheet extension 56 functions as described herein as noted above.

The sheet extension 56 may also be provided with side ventilation holes (not shown), or the sheet extension 56 can be made from gas permeable or impermeable materials. When multiple sheets of material are used together, they may be connected together or laminated, or may comprise separate layers. Finally, it will be appreciated that the sheet extension 56 may be substantially flat or angled such that when disposed about the flower pot 10 and the support member 26 or any other container supported on the support member 26, the sheet extension extends a distance upwardly and outwardly from the flower pot 10. Any thickness of the sheet of material 38*b* and the sheet extension 56 may be utilized in accordance with the present invention as long as the sheet of material 38*b* and the sheet extension 56 may be disposed about the flower pot 10 as described herein. Typically the sheet of material 38*b* and the sheet extension 56 have a thickness range of from about 0.1 mils to about 30 mils. The sheet of material 38*b* and the sheet extension 56 may be constructed from one sheet of polymer film having a thickness in a range of from about 0.5 mils to about 2.5 mils. In an alternate embodiment, the sheet of material 38*b* and the sheet extension 56 may be constructed from polymer film having a thickness in a range of from about 0.2 mils to about 10 mils.

The sheet extension 56 may be made of a similar material as the sheet of material 38*b* or the sheet of material 38*b* and the sheet extension 56 may be made of different types of material. Thus, the only requirement is that the sheet extension 56 be constructed from any suitable material that is capable of being disposed about a container such as a flower pot 10. Examples of materials suitable for use are paper (untreated or treated in any manner), cellophane, foil, polymer film, fiber (woven or non-woven or synthetic or natural), cloth (woven or non-woven or natural or synthetic), burlap, or any combination thereof.

The sheet extension 56 may also be constructed in whole or in part from a cling material or polymer film. The cling material is constructed and treated if necessary from polyethylene such as Cling Wrap made by Glad®, First Brands Corporation, Danbury, Conn. The thickness of the cling material will, in part, depend upon the size of sheet of material 38*b* and the size of the container wrapped within the sheet of material 38*b*, i.e., generally, a larger flower pot may require a thicker and therefore stronger cling material. The cling material will range in thickness from about 0.1 mils to about 10 mils, and preferably from about 0.5 mils to about 2.5 mils and most preferably from about 0.6 to about 2 mils.

The sheet extension 56 may vary in color. Further, the sheet extension 56, may consist of designs which are printed, etched, and/or embossed; in addition, the sheet of material 38*b* may have various colorings, coatings, flockings, and/or metallic finishes, or be characterized totally or partially by pearlescent, translucent, transparent, iridescent, or the like characteristics. Each of the above-named characteristics may occur alone or in combination. Moreover, each surface of the sheet extension 56 may vary in the combinations of such characteristics. The sheet of material 38*b* and the sheet extension 56 may also be constructed from one or more sheets of polypropylene films or a combination of one or more sheets of polypropylene film and a sheet of foil wherein at least a lower or outer surface of one of the sheets of material may be provided with a three dimensional pattern printed thereon, a printed pattern, an embossed pattern and combinations thereof. The sheets of material employed to produce the sheet of material 38*b* and/or the sheet extension 56 may be connected together or laminated or may be separate layers. In an alternative embodiment, the sheet of material 38*b* and/or the sheet extension 56 may be constructed from only one sheet of polypropylene film.

EMBODIMENT OF FIGS. 13–14

Figure 13:
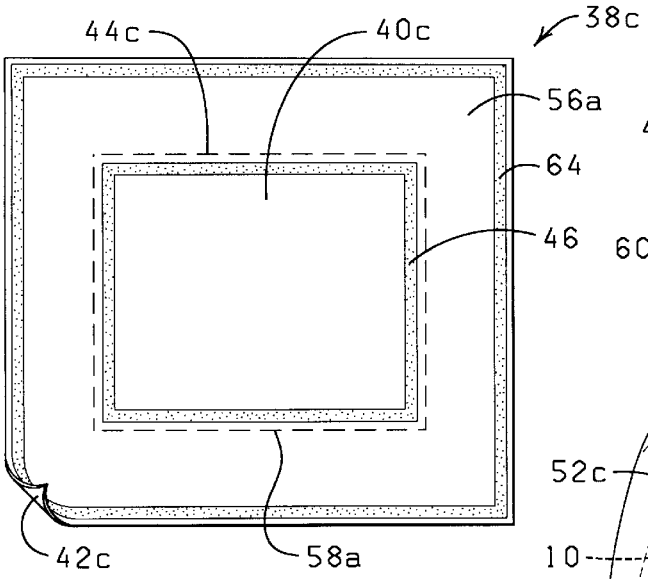
FIG. 13 is pictorial representation of another embodiment of a sheet of material having a detachable sheet extension, the sheet of material and the sheet extension each having a bonding material thereon.

Referring to FIG. 13, shown therein and designated by the general reference numeral 38*c* is a sheet of material having a top side 40*c*, a bottom side 42*c*, a periphery 44*c*, a detachable sheet extension 56*a* extending a distance beyond the periphery 44*c*, and a plurality of perforations 58*a* disposed between the sheet extension 56*a* and the periphery 44*c*. The sheet extension 56*a* is formed integrally with the sheet of material 38*c* and is detachable therefrom along the plurality of perforations 58*a*. A bonding material 46*c* is disposed upon a portion of the top side 40*c* of the sheet of material 38*c*, preferably a distance from the periphery 44*c* and a bonding material 64 is disposed on a portion of the sheet extension 56*a*.

Figure 14:
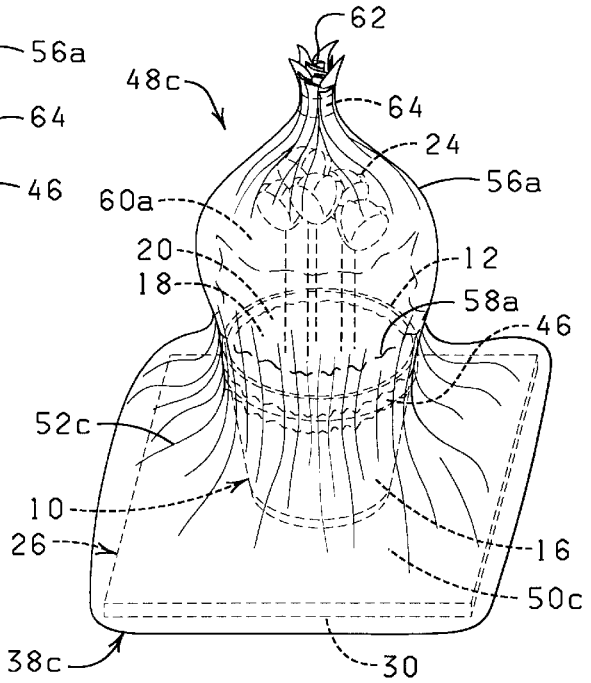
FIG. 14 is a pictorial representation of another embodiment of a packaging assembly wherein the sheet of material of FIG. 13 is disposed about the support member and flower pot of FIG. 1 and bondingly secured to an outer peripheral surface of the flower pot, the sheet extension extending a distance from the flower pot thereby defining an item receiving cavity, and the sheet extension gathered a distance above the flower pot thereby enclosing the item receiving cavity so as to provide a packaging assembly for shipping the flower pot in accordance with the present invention.

Shown in FIG. 14, the support member 26 and the flower pot 10 of FIG. 1 are positioned on the sheet of material 38*c* of FIG. 13 such that the sheet of material 38*c* is disposed substantially adjacent the lower surface 30 of the support member 26. Thereafter, the sheet of material 38*c* is wrapped about the support member 26 and a portion of the flower pot 10 to provide a packaging assembly 48*c* substantially as shown. A portion of the sheet of material 38*c* is disposed about a portion of the flower pot 10 such that the sheet of material 38*c* encompasses the support member 26 and a portion of the flower pot 10. The sheet of material 38*c* is disposed about the support member 26 and the flower pot 10 such that a storage cavity 50*c* is formed between the support member 26, the flower pot 10, and the sheet of material 38*c*. The sheet of material 38*c* is gathered about the outer peripheral surface 16 of the flower pot 10 thereby forming a plurality of gathered portions 52*c*. The gathered portions 52*c* of the sheet of material 38*c* are secured to the outer peripheral surface 16 of the flower pot 10 via the bonding material 46*c* disposed on a portion of the sheet of material 38*c*. The sheet extension 56*a* is disposed about a portion of the container and extended a distance from the flower pot 10 such that the upper end 12 of the flower pot 10 remains substantially uncovered thereby providing access to the internal cavity 18 of the flower pot 10 via opening 20 in the upper end 12 of the flower pot 10. Thus, the sheet extension 56*a* encompasses a portion of the flowers 24 extending a distance above the flower pot 10 and defines an item receiving cavity 60*a* capable of receiving a predetermined number of items. The sheet extension 56*a* is detachable from the sheet of material 38*c* along the plurality of perforations 58*a*. The sheet extension 56*a* is gathered a distance above the flower pot 10 to form a plurality of gathered portions 62 thereby enclosing the item receiving cavity 60*a*. The gathered portions 62 of the sheet extension 56*a* are secured in the gathered position via bonding material 64.

The sheet extension 56*a* is a generally flat sheet of material, described previously, formed integrally with the sheet of material 38*c* thereby forming a larger rectangular sheet of material. The sheet extension 56*a* is sized to encompass a substantial portion of the flowers 24 extending from the flower pot 10. The sheet extension 56*a* may be secured a distance above the flower pot 10 in the substantially closed position by any means capable of enclosing sheet extension 56*a* such that the flowers 24 of the flower pot 10 are enclosed within the item receiving cavity 60*a* so as to provide a decorative appearance and/or a protective guard around the flowers 24 of the flower pot 10. It should be understood that the sheet extension 56*a* may be crimped, banded, bonded, or otherwise secured a distance above the flower pot 10. Depending on the flexibility or rigidity of the material employed in the sheet extension 56*a*, the sheet extension 56*a* may be shaped into a variety of decorative positions about the flowers 24. The sheet extension 56*a* may be shaped about the flowers 24 thereby forming a variety of shapes such as a loosely fitting balloon or a form fitting cover. As previously stated, the sheet of material 38*c* may be formed integrally with the sheet of material 38*c* such that the sheet extension 56*a* is detachably connected to sheet of material 38*c* by any means capable of connecting the sheet extension 56*a* to the sheet of material 38*c* whereby the sheet extension 56*a* may be easily removed from the sheet of material 38*c*. Detachment means such as the perforations 58*a* are described previously and incorporated by reference herewith.

The bonding material 64 may be a securing assembly, previously described, disposable about one of at least a portion of the sheet extension 56*a*, at least a portion of at least one gathered portion 62 and combinations thereof for securing one of at least a portion of the sheet extension 56*a* in the closed position a distance above the flower pot 10, at least a portion of at least one gathered portion 62 in the gathered position, and combinations thereof. It should be understood that the bonding material 64 may be any means capable of securing the sheet extension 56*a* about the flower pot 10. Depending on the size and shape of the sheet extension 56*a*, the sheet extension 56*a* may be, but not by way of limitation, banded, tied, crimped, bonded, heat sealed, or otherwise secured about the flower pot 10 and/or the flowers 24. It should be understood that when employing certain materials such as foil for the sheet extension 56*a*, the sheet extension 56*a* may be gathered to form gathered portions 62 thereby conforming the sheet extension 56*a* a distance above the flower pot 10 without the aid of a bonding material 64.

EMBODIMENT OF FIGS. 15–17

Figure 15:
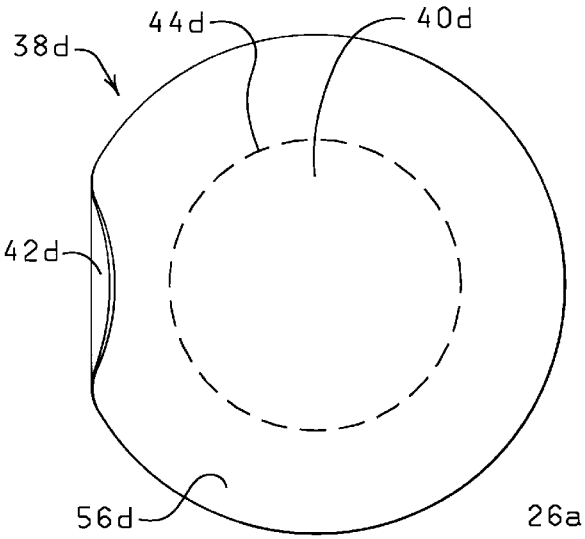
FIG. 15 is a pictorial representation of a sheet of material having a detachable sheet extension, the sheet of material disposable about a support member and at least a portion of a bowl so as to provide a packaging assembly for shipping a bowl constructed in accordance with the present invention.

Referring to FIG. 15 and designated by the general reference numeral 38*d* is a sheet of material having a top side 40*d*, a bottom side 42*d*, a periphery 44*d*, and a sheet extension 56*b* extending a distance beyond the periphery 44*d*. The sheet of material 38*d* and the sheet extension 56*b* are integrally formed and are provided with a circular configuration.

Figure 16:
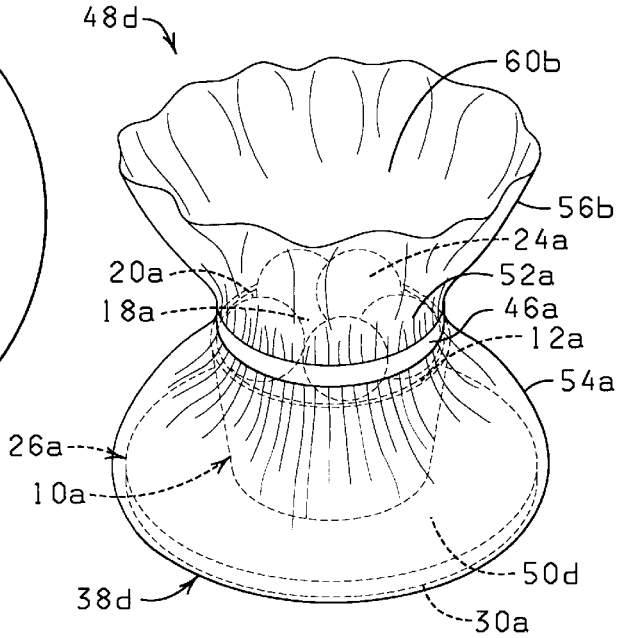
FIG. 16 is a pictorial representation of a packaging assembly wherein the sheet of material having a detachable sheet extension of FIG. 15 is disposed about a support member and a bowl, the sheet of material crimped and banded adjacent an upper end of the bowl such that the sheet extension extends a distance from the bowl thereby defining an item receiving cavity so as to provide a packaging assembly for shipping the bowl in accordance with the present invention.

Shown in FIG. 16, the support member 26*a* and the bowl 10*a* of FIG. 2 are positioned on the sheet of material 38*d* of FIG. 7 such that the sheet of material 38*d* is disposed substantially adjacent the lower surface 30*a* of the support member 26*a*. Thereafter, the sheet of material 38*d* is wrapped about the support member 26*a* and the bowl 10*a* to provide a packaging assembly 48*d* substantially as shown. The sheet of material 38*d* is disposed about the support member 26*a* and the bowl 10*a* such that a storage cavity 50*d* is formed between the support member 26*a*, the bowl 10*a*, and the sheet of material 38*d*. The sheet of material 38*d* is crimped adjacent the upper end 12*a* of the bowl 10*a* thereby forming a plurality of crimped portions 52*a*. The crimped portions 52*a* of the sheet of material 38*d* are secured adjacent the upper end 12*a* of the bowl 10*a* via the band 46*a*. The crimped portions 52*a* of the sheet of material 38*d* are disposed about the bowl 10*a* such that the upper end 12*a* of the bowl 10*a* remains substantially uncovered thereby providing access to the internal cavity 18*a* of the bowl 10*a* via the opening 20*a* in the upper end 12*a* of the bowl 10*a*. The sheet extension 56*b* extends a distance beyond the bowl 10*a* thereby defining an item receiving cavity 60*b*. The sheet extension 56*b* encompasses a portion of the fruit 24*a* extending a distance above the bowl 10*a*.

The sheet extension 56*b* may be disposed adjacent the upper end 12*a* of the bowl 10*a* such that the sheet extension 56*b* extends beyond the sheet of material 38*d*. The sheet of material 38*d* may be of a sufficient size so that when the sheet of material 38*b* is wrapped about the flower pot 10*a* and the support member 26*a*, the sheet extension 56*b* is disposed about at least a portion of the fruit 24*a* extending from the upper end 12*a* of the bowl 10*a*.

While the band 46*a* has been depicted for securing the sheet of material 38*d* substantially adjacent the upper end 12*a* of the bowl 10*a* via the crimped portions 52*a*, it would be understood that the band 46*a* can also be positioned about an uncrimped portion 54*a* of the sheet 26*a*. Further, more than one of the bands 46*a* can be employed. As stated previously, it should be understood that while the band 46*a* has been illustrated for securing the sheet of material 38*d* about the bowl 10*a* and the support member 26*a*, any other suitable means capable of securing the sheet of material 38*d* about the bowl 10*a* can be employed in accordance with the present invention. For example, depending on the size and shape of the sheet of material 38*d*, the sheet of material 38*d* may be, but not by way of limitation, banded, tied, crimped, bonded, heat sealed, or otherwise secured about the support member 26*a* and the bowl 10*a*. It should be understood that when employing certain materials such as foil for the sheet of material 38*d*, the sheet of material 38*d* may be gathered to form crimped portions 52*a* thereby conforming the sheet of material 38*d* about the bowl 10*a* without the aid of the band 46 or any other securing means. However, the sheet of material 38*d* is desirably secured about the bowl 10*a* and the support member 26*a* such that the sheet of material 38*d* holds the bowl 10*a* in the substantially upright position on the support member 26*a*.

The sheet extension 56*b* is a generally flat sheet of material, described previously, formed integrally with the sheet of material 38*d* thereby forming a larger circular sheet of material. The sheet extension 56*b* is sized to encompass at least a portion of the fruit 24*a* extending from the bowl 10*a*. The sheet extension 56*b* may be angled, ruffled, folded, crimped, gathered, or otherwise formed about the fruit 24*a* of the bowl 10*a* so as to provide a decorative appearance and a protective guard around the fruit 24*a* of the bowl 10*a*.

Figure 17:
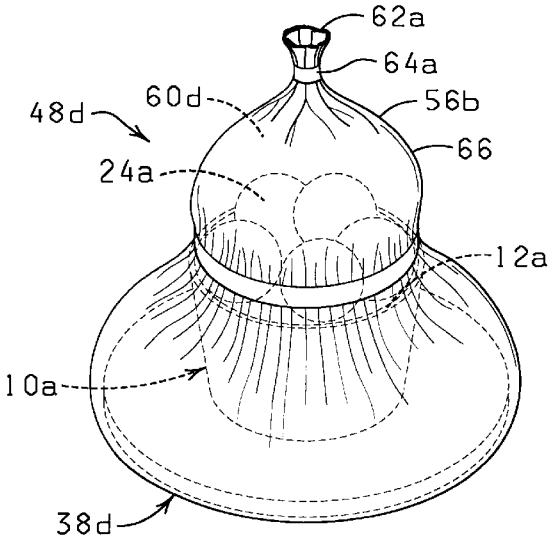
FIG. 17 is a pictorial representation of a packaging assembly wherein the sheet of material having a sheet extension of FIG. 15 is disposed about a support member and the upper end of the bowl such that the sheet extension extends a distance above the bowl, a portion of the sheet extension being crimped and banded a distance above an upper end of the bowl thereby enclosing the item receiving cavity so as to provide a packaging assembly for shipping the bowl in accordance with the present invention.

Shown in FIG. 17, the packaging assembly 48*d* of FIG. 16 wherein the sheet extension 56*b* of the sheet of material 38*d* of FIG. 15 is crimped to form a plurality of crimped portions 62*a* a distance above the upper end 12*a* of the bowl 10*a*. The sheet extension 56*b* is crimped a distance above the bowl 10*a* to form a plurality of crimped portions 62*a* thereby enclosing the item receiving cavity 60*b*. The crimped portions 62*a* of the sheet extension 56*b* are secured in the crimped position via band 64*a*.

While the band 64*a* has been depicted for securing the sheet extension 56*b* a distance above the upper end 12*a* of the bowl 10*a*, it should be understood that the band 64*a* can also be positioned about an uncrimped portion 66 of the sheet extension 56*b*. Further, more than one of the band 64*a* can be employed. As stated previously, it should be understood that while the band 64*a* has been illustrated for securing the sheet extension 56*b* a distance above the bowl 10*a*, any other suitable means capable of securing the sheet extension 56*b* in the substantially closed position above the bowl 10*a* and/or the crimped portions 62*a* in the crimped position can be employed in accordance with the present invention. For example, depending on the size and shape of the sheet extension 56*b*, the sheet extension 56*b* may be, but not by way of limitation, banded, tied, crimped, bonded, heat sealed, or otherwise secured a distance above the bowl 10*a*. It should be understood that when employing certain materials such as foil for the sheet of material 38*d*, the sheet of material 38*d* may be crimped to form crimped portions 62*a* thereby enclosing the item receiving cavity 60*b* without the aid of a band 64*b*. However, the sheet extension 56*b* is desirably secured a distance above the bowl 10*a* such that the sheet extension 56*b* encompasses the fruit 24*a*.

EMBODIMENTS OF FIGS. 18–21

Figure 18:
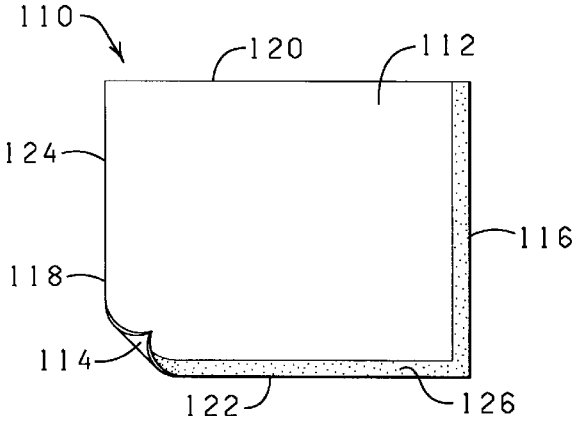
FIG. 18 is a pictorial representation of a sheet extension having a bonding material thereon, the sheet of material disposable about a support member and at least a portion of a flower pot so as to provide a packaging assembly for shipping a flower pot constructed in accordance with the present invention.

Referring to FIG. 18, shown therein, and designated by the general reference numeral 110 is a sheet extension having a top side 112, a bottom side 114, a first end 116, a second end 118, a top edge 120, a bottom edge 122, and a periphery 124. A bonding material 126 is disposed upon a portion of the first end 116 and the bottom edge 122.

Figure 19:
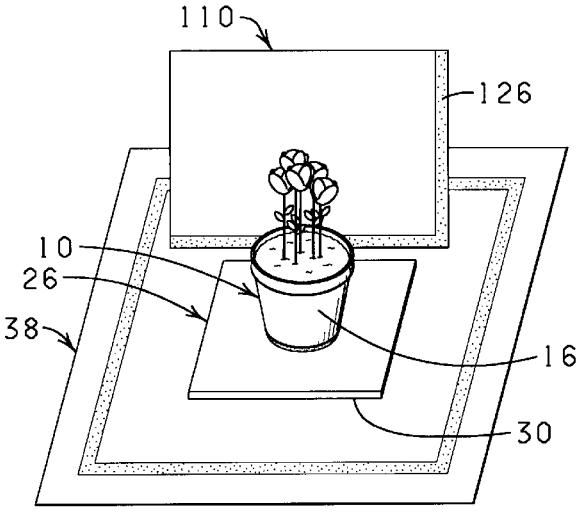
FIG. 19 is a pictorial representation of the flower pot and support member of FIG. 1 disposed on the sheet of material of FIG. 4 in combination with the sheet extension of FIG. 18.

Shown in FIG. 19, the support member 26 and the flower pot 10 of FIG. 1 are positioned on the sheet of material 38 of FIG. 4 such that the sheet of material 38 is disposed substantially adjacent the lower surface 30 of the support member 26 and the sheet extension 110 is disposed substantially adjacent a portion of the outer peripheral surface 16 of the flower pot 10. The sheet extension 110 is then wrapped about the outer peripheral surface 16 of the flower pot 10 and secured about the flower pot 10 via the bonding material 126. Thereafter, the sheet of material 38 is wrapped about the support member 26, a portion of the flower pot 10, and the sheet extension 110 to provide a packaging assembly 48*e* substantially as shown in FIG. 20.

Figure 20:
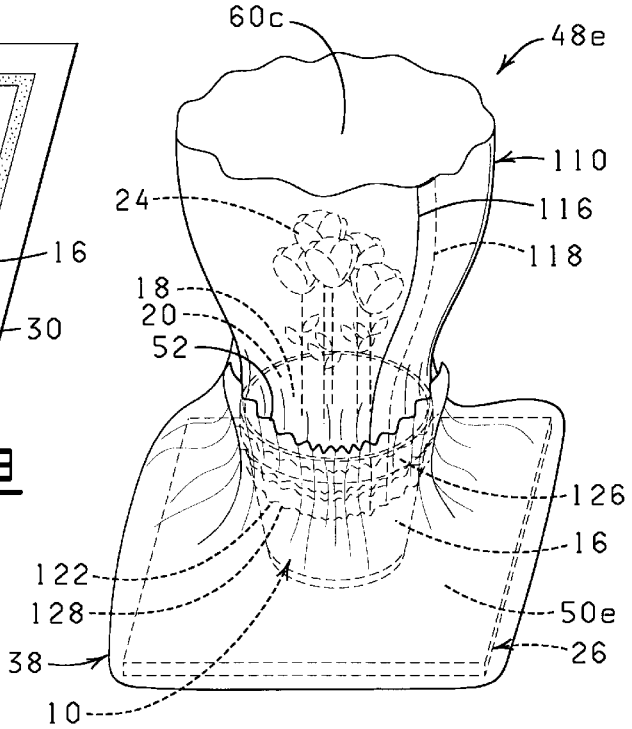
FIG. 20 is a pictorial representation of another embodiment of a packaging assembly wherein the sheet extension of FIG. 18 and the sheet of material of FIG. 4 are disposed about the flower pot and support member of FIG. 1 such that the sheet extension extends from the flower pot and defines an item receiving cavity in accordance with the present invention.

Referring now to FIG. 20, the sheet extension 110 is wrapped about a portion of the flower pot 10 such that the first end 116 overlappingly engages the second end 118 of the sheet extension 110. The bonding material 126 disposed along the first end 166 of the sheet extension 110 secures a portion of the first end 116 to the second end 118 of the sheet extension 110 thereby forming an item receiving cavity 60*c*. The bottom edge 122 of the sheet extension 110 is secured about the outer peripheral surface 16 of the flower pot 10 via the bonding material 126 disposed along the bottom edge 122 of the sheet extension 110. The sheet extension 110 extends a distance beyond the flower pot 10 thereby surrounding the flowers 24 extending a distance above the flower pot 10.

A portion of the sheet of material 38 is disposed about a portion of the flower pot 10 such that the sheet of material 38 encompasses the support member 26, a portion of the flower pot 10, and a portion of the sheet extension 110. The sheet of material 38 is disposed about the support member 26 and the flower pot 10 such that the storage cavity 50 is formed between the support member 26, the flower pot 10, and the sheet of material 38. The sheet of material 38 is gathered about the outer peripheral surface 16 of the flower pot 10 and a portion of the sheet extension 110 thereby forming a plurality of gathered portions 52. The gathered portions 52 of the sheet of material 38 are then secured to a portion of the sheet extension 110 secured about the outer peripheral surface 16 of the flower pot 10 via the bonding material 46. The gathered portions 52 of the sheet of material 38 are disposed about the flower pot 10 such that the upper end 12 of the flower pot 10 remains substantially uncovered by the sheet of material 38 and the sheet extension 110 thereby providing access to the internal cavity 18 of the flower pot 10 via the opening 20 in the upper end 12 of the flower pot 10.

While the sheet extension 110 has been depicted as a generally flat, rectangular sheet of material disposable about at least a portion of the flower pot 10 and at least a portion of the flowers 24 extending therefrom, it should be understood that the sheet extension 110 may be provided with any shape, whether geometric, non-geometric, asymmetrical and/or fanciful as long as it functions in accordance with the present invention. The sheet extension 110 may be, by way of example but not by way of limitation, circular, conical, combinations thereof, or any other shape, as long as the sheet extension 110 functions as described herein as noted above.

The sheet extension 110 may also be equipped with side ventilation holes (not shown), or can be made from gas permeable or impermeable materials. The sheet extension 110 may be constructed of a single sheet extension 110 or a plurality of sheet extensions 110. When multiple sheets of material are used as the sheet extension 110 together, they may be connected together or laminated, or may comprise separate layers. Finally, it will be appreciated that the sheet extension 110 may be substantially flat or angled such that when disposed about the flower pot 10 or any other container supported on the support member 26, the sheet extension 110 extends a distance upwardly and outwardly from the flower pot 10. Any thickness of the sheet extension 110 may be utilized in accordance with the present invention as long as the sheet extension 110 may be disposed about the flower pot 10 as described herein. Typically the sheet extension 110 has a thickness range of less than about 0.2 mils to about 30 mils. The sheet extension 110 may be constructed from one sheet of polymer film having a thickness in a range of from less than about 0.5 mils to about 2.5 mils. In an alternate embodiment, the sheet extension 110 may be constructed from polymer film having a thickness in a range of from less than about 0.2 mils to about 10 mils.

The sheet extension 110 may be made of a similar material as the sheet of material 38 or the sheet of material 38 and the sheet extension 110 may be made of different types of material. Thus, the only requirement is that the sheet extension 110 is constructed from any suitable material that is capable of being disposed about the flower pot 10 or any other container disposed on the support member. Examples of material suitable for use are paper (untreated or treated in any manner), cellophane, foil, polymer film, fiber (woven or non-woven or synthetic or natural), cloth (woven or non-woven or natural or synthetic), burlap, or any combination thereof.

The sheet extension 110 may also be constructed in whole or in part from a cling material or polymer film. The cling material is constructed and treated if necessary from polyethylene such as Cling Wrap made by Glad®, First Brands Corporation, Danbury, Conn. The thickness of the cling material will, in part, depend upon the size of sheet extension 110 and the size of the flower pot 10 in the sheet extension 110, i.e., generally, a larger flower pot 10 may require a thicker and therefore stronger cling material. The cling material will range in thickness from about 0.1 mils to about 10 mils, and preferably from about 0.5 mils to about 2.5 mils and most preferably from about 0.6 to about 2 mils. However, any thickness of cling material may be utilized in accordance with the present invention which permits the cling material to be printed with a foamable ink composition so as to provide the cling material with a three dimensional printed pattern which is capable of functioning as described herein.

The sheet extension 110 may vary in color. Further, the sheet extension 110 may consist of designs which are printed, etched, and/or embossed; in addition, the sheet extension 110 may have various colorings, coatings, flockings, and/or metallic finishes, or be characterized totally or partially by pearlescent, translucent, transparent, iridescent, or the like characteristics. Each of the above-named characteristics may occur alone or in combination. Moreover, each surface of the sheet extension 110 may vary in the combinations of such characteristics.

The sheet extension 110 may be constructed from one or more polypropylene films or a combination of one or more sheets of polypropylene film and a sheet of foil wherein at least a lower or outer surface of one of the sheets of may be provided with a three dimensional pattern printed thereon, a printed pattern, an embossed pattern, and combinations thereof. The sheets of material employed to produce the sheet extension 110 may be connected together or laminated or may be separate layers. In an alternative embodiment, the sheet extension 110 may be constructed from only one sheet of polypropylene film.

The sheet extension 110 may further comprise an ink, dye, and/or pigment (not shown). Such inks, dyes, and pigments are known in the art, and are commercially available, and may be disposed upon or incorporated in the sheet extension 110 by any method described herein or known in the art. For example, the ink, dye, or pigment may form a portion of a design or decoration on the sheet extension 110, such as flowers, leaves, and the like.

The bonding material 126 may be a securing assembly, previously described, and more preferably a pressure sensitive adhesive disposable on at least a portion of at least one side of the sheet extension 110 for securing the sheet extension 110 about at least a portion of the flower pot 10 and at least a portion of the flowers 24. The sheet extension 110 may be bondingly secured to one of the outer peripheral surface 16 of the flower pot 10, the sheet of material 38, the upper end 12 of the flower pot 10, and combinations thereof. It should be understood that when employing certain materials such as foil for the sheet extension 110, the sheet extension 110 may be gathered to form gathered portions 128 thereby conforming the sheet extension 110 about the flower pot 10 without the aid of a bonding material 126.

Figure 21:
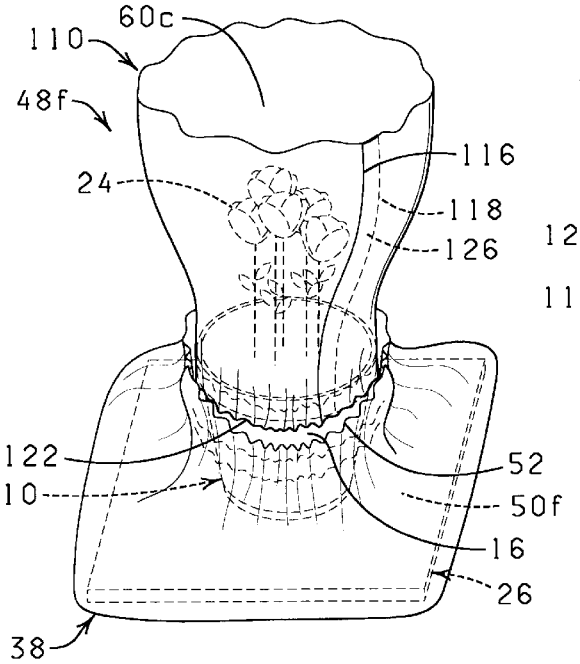
FIG. 21 is a pictorial representation of the packaging assembly of FIG. 20 wherein the sheet extension of FIG. 18 is disposed about an upper portion of a flower pot and the sheet of material of FIG. 4 is disposed about the support member and a portion of the outer peripheral surface of the flower pot such that the sheet extension is disposed a distance from the sheet of material.

Referring now to FIG. 21, the sheet extension 110 is wrapped about a portion of the flower pot 10 such that the first end 116 overlappingly engages the second end 118 of the sheet extension 110. The bonding material 126 disposed on the sheet extension 110 secures a portion of the first end 116 to the second end 118 of the sheet extension 110 thereby forming an item receiving cavity 60*c*. The bottom edge 122 of the sheet extension 110 is secured about the outer peripheral surface 16 of the flower pot 10 via the bonding material 126 disposed on a portion of the sheet extension 110. The sheet extension 110 extends a distance beyond the flower pot 10 thereby surrounding the flowers 24 extending a distance above the flower pot 10.

A portion of the sheet of material 38 is disposed about a portion of the flower pot 10 such that the sheet of material 38 encompasses the support member 26 and a portion of the flower pot 10 to provide a packaging assembly 48*f* substantially as shown in FIG. 21. The sheet of material 38 is disposed about the support member 26 and the flower pot 10 such that a storage cavity 50*f* is formed between the support member 26, the flower pot 10, and the sheet of material 38. The sheet of material 38 is gathered about the outer peripheral surface 16 of the flower pot 10 thereby forming a plurality of gathered portions 52. The gathered portions 52 of the sheet of material 38 are then secured a distance from the sheet extension 110 secured about the outer peripheral surface 16 of the flower pot 10 via the bonding material 126.

EMBODIMENT OF FIGS. 22–23

Figure 22:
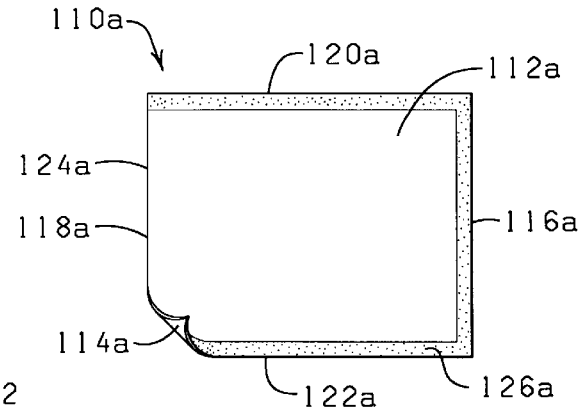
FIG. 22 is a pictorial representation of a sheet extension having a bonding material thereon for securing the first end of the sheet extension to the second end of the sheet extension, the sheet extension disposable about a portion of a flower pot so as to provide a packaging assembly for shipping a container in accordance with the present invention.

Referring to FIG. 22, shown therein and designated by the general reference numeral 110*a* is a sheet extension having a top side 112*a*, a bottom side 114*a*, a first end 116*a*, a second end 118*a*, a top edge 120*a*, a bottom edge 122*a*, and a periphery 124*a*. A bonding material 126*a* is disposed upon a portion of the first end 116*a*, a portion of the bottom edge 122*a*, and a portion of the top edge 120*a*.

Figure 23:
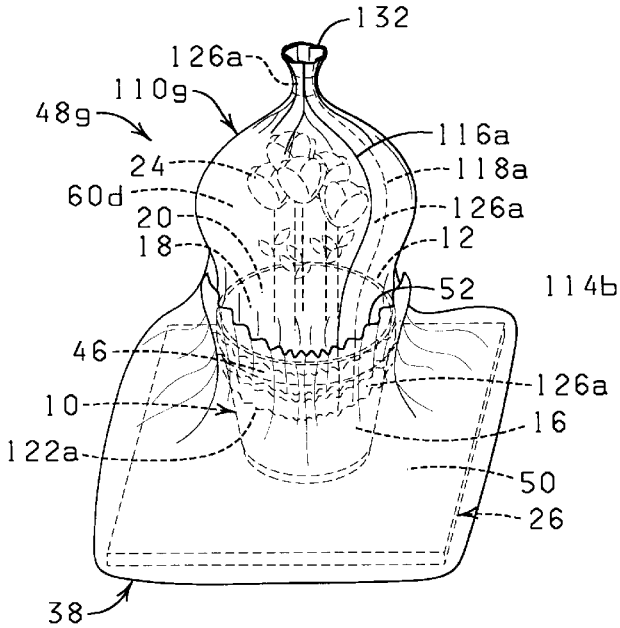
FIG. 23 is a pictorial representation of another embodiment of a packaging assembly wherein the sheet extension of FIG. 22 and the sheet of material of FIG. 4 are disposed about the flower pot and support member of FIG. 1 such that the sheet extension extends a distance from the flower pot and the sheet extension defines an item receiving cavity, the sheet extension being gathered a distance above the container thereby enclosing an item receiving cavity formed by the sheet extension.

Referring now to FIG. 23, the sheet extension 110*a* is wrapped about a portion of the flower pot 10 such that the first end 116*a* overlappingly engages the second end 118*a* of the sheet extension 110*a*. The bonding material 126*a* disposed on the sheet extension 110*a* secures a portion of the first end 116*a* to the second end 118*a* of the sheet extension 110*a* thereby forming an item receiving cavity 60*d*. The bottom edge 122*a* of the sheet extension 110*a* is secured about the outer peripheral surface 16 of the flower pot 10 via the bonding material 126*a* disposed on a portion of the sheet extension 110*a*. The sheet extension 110*a* extends a distance beyond the flower pot 10 thereby surrounding the flowers 24*a* extending a distance above the flower pot 10. A portion of the sheet extension 110*a* is gathered to form a plurality of gathered portions 132 a distance above the flower pot thereby enclosing the item receiving cavity 60*d*. The bonding material 126*a* secures the gathered portions 132 in the gathered position a distance above the flower pot 10.

A portion of the sheet of material 38 is disposed about a portion of the flower pot 10 such that the sheet of material 38 encompasses the support member 26, a portion of the flower pot 10, and a portion of the sheet extension 110*a* to provide a packaging assembly 48*g* substantially as shown in FIG. 23. The sheet of material 38 is disposed about the support member 26 and the flower pot 10 such that a storage cavity 50 is formed between the support member 26, the flower pot 10, and the sheet of material 38. The sheet of material 38 is gathered about the outer peripheral surface 16 of the flower pot 10 and a portion of the sheet extension 110*a* thereby forming a plurality of gathered portions 52. The gathered portions 52 of the sheet of material 38 are then secured to a portion of the sheet extension 110*a* secured about the outer peripheral surface 16 of the flower pot 10 via the bonding material 46. The gathered portions 52 of the sheet of material 38 are disposed about the flower pot 10 such that the upper end 12 of the flower pot 10 remains substantially uncovered thereby providing access to the internal cavity 18 of the flower pot 10 via the opening 20 in the upper end 12 of the flower pot 10.

EMBODIMENT OF FIGS. 24–27

Figure 24:
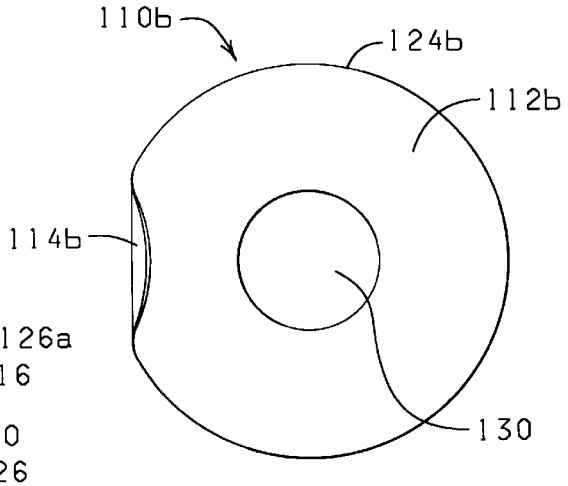
FIG. 24 is a pictorial representation of a sheet extension having a hole therethrough such that the sheet extension is disposable about a portion of a bowl to provide a packaging assembly for shipping a bowl in accordance with the present invention.

Referring to FIG. 24 and designated by the general reference numeral 110*b* is a sheet extension having a top side 112*b*, a bottom side 114*b*, a periphery 124*b*, and a hole 130 therethrough.

While the sheet extension 110*b* is depicted as a generally flat, circular sheet of material, it should be understood that the sheet extension 110*b* may be provided with any shape, whether geometric, non-geometric, asymmetrical and/or fanciful as long as it functions in accordance with the present invention. The sheet extension 110*b* may be, by way of example but not by way of limitation, rectangular, conical, combinations thereof, or any other shape, as long as the sheet extension 110*b* functions as described herein.

Figure 25:
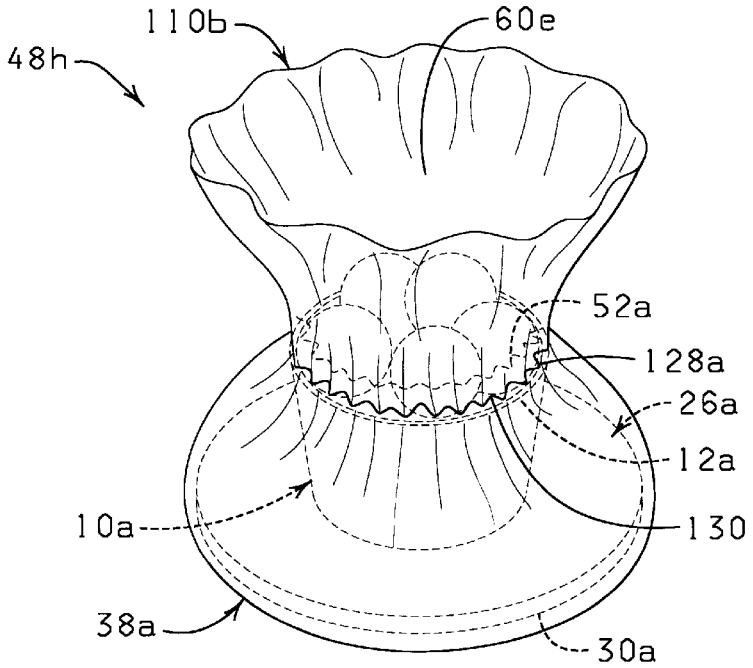
FIG. 25 is a pictorial representation of a packaging assembly wherein the sheet extension of FIG. 24 is disposed about the packaging assembly of FIG. 9 such that the sheet extension extends a distance from the bowl so as to define an item receiving cavity.

Shown in FIG. 25, the support member 25*a* and the bowl 10*a* of FIG. 2 are positioned on the sheet of material 38*a* of FIG. 7 such that the sheet of material 38*a* is disposed substantially adjacent the lower surface 30*a* of the support member 26*a*. The sheet of material 38*a* is disposed about the support member 26*a* and the bowl 10*a*. A portion of the sheet of material 38*a* is crimped to form a plurality of crimped portions 52*a* adjacent the upper end 12*a* of the bowl 10*a*. Thereafter, the upper end of the bowl 10*a* having the sheet of material 38*a* thereabout is disposed within the hole 130 of the sheet extension 110*b* to provide a packaging assembly 48*h* substantially as shown in FIG. 25. The sheet extension 110*b* is crimped about a portion of the sheet of material 38*a* adjacent the upper end 12*a* of the bowl 10*a* to form a plurality of crimped portions 128*a*. The sheet extension 110*b* is extended a distance upwardly and outwardly beyond the bowl 10*a* thereby forming an item receiving cavity 60*e*.

Figure 26:
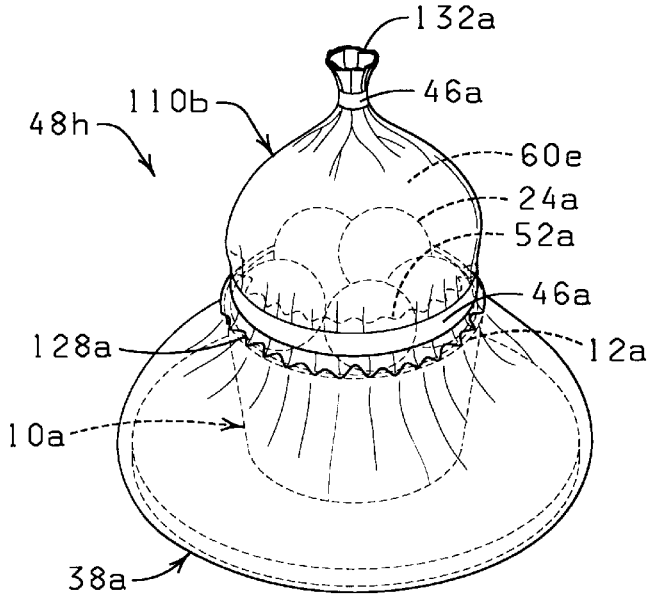
FIG. 26 is a pictorial representation of the packaging assembly of FIG. 25 wherein a portion of the sheet extension is crimped and banded about a portion of the sheet of material adjacent the upper end of the bowl and a portion of the sheet extension is crimped and banded a distance above the container thereby enclosing the item receiving cavity defined by the sheet extension so as to provide a packaging assembly for shipping a bowl in accordance with the present invention.

FIG. 26 shows the packaging assembly 48*h* of FIG. 25 wherein the sheet extension 110*b* is secured adjacent the upper end 12*a* of the bowl 10*a* and about a portion of the sheet of material 38*a* via a band 46*a* and wherein a portion of the sheet extension 110*b* is crimped a distance above the bowl 10*a* thereby forming a plurality of top crimped portions 132*a*. A second band 46*a* is disposed about a portion of the sheet extension 110*b* for securing the sheet extension 110*b* a distance above the bowl 10*a* thereby encompassing a substantial portion of the fruit 24*a* extending a distance above the bowl 10*a*. The second band 46*a* is disposed about the sheet extension 110*b* thereby securing a portion of the top crimped portions 132*a* of the sheet extension 110*b* in the crimped position a distance above the bowl 10*a* thereby enclosing the item receiving cavity 60*e*.

The bands 46*a* are disposable about one of the sheet of material 38*a*, the sheet extension 110*b*, and combinations thereof for securing one of the sheet of material 38*a*, the sheet extension 110*b*, the crimped portions 52*a* of the sheet of material 38*a*, the crimped portions 128*b* of the sheet extension 110*a*, the top crimped portions 132*a* of the sheet extension, and combinations thereof about the bowl 10*a*. The bands 46*a* may be any securing means, as previously described, capable of securing the sheet extension 110*a* about one of the bowl 10*a*, the sheet of material 38*a*, and combinations thereof. It should be understood that when employing certain materials such as foil for the sheet extension 110*a*, the sheet extension 110*a* may be gathered to form crimped portions 128*a* thereby conforming the sheet extension 110*a* about the bowl 10*a* without the aid of a bonding material or a band.

What is claimed is:

1. A packaging assembly, comprising:

a container having an upper end, a lower ends and an outer surface and a floral grouping disposed therein;

a support member having an upper support surface, a lower surface, and a periphery, the lower end of the container disposed on the upper support surface of the support member in a non-connected relationship with respect to the support member and with the container oriented in a substantially upright position; and a sheet of material wrapped and secured about the support member and the container and the floral grouping such that the support member, the container, and the floral grouping are enclosed within and covered by the sheet of material and the container is supported in its upright position by the combination of the sheet of material and the support member so as to prevent the container and the floral grouping from toppling during transport.

2. The packaging assembly of claim 1 wherein at least a portion of the sheet of material is secured to the container.

3. The packaging assembly of claim 1 wherein the portion of the sheet of material secured about the container is gathered about the container forming a gathered or crimped portion in the sheet of material.

4. The packaging assembly of claim 2 wherein the sheet of material is secured to the container with a bonding material.

5. The packaging assembly of claim 4, wherein the bonding material is disposed on a portion of the sheet of material so as to connect at least a portion of the sheet of material to the container or to connect overlapping folds formed in the sheet of material together and thereby secure the sheet of material about the outer surface of the container.

6. The packaging assembly of claim 4, wherein the bonding material is selected from the group of cohesives, adhesives, and combinations thereof.

7. The packaging assembly of claim 4, wherein the bonding material is disposed on at least a portion of the outer surface of the container so as to connect at least a portion of the sheet of material to the outer surface of the container.

8. The packaging assembly of claim 1, wherein the support member is dimensioned such that the periphery of the support member extends radially outward a distance beyond the outer surface of the container.

9. The packaging assembly of claim 1, wherein an outer portion of the sheet of material is selectively detachable from the remaining portion of the sheet of material such that the floral grouping is exposed while the sheet of material remains secured to the container when the outer portion of the sheet of material is detached.

10. The packaging assembly of claim 9, wherein the outer portion of the sheet of material is delineated relative to the remaining portion of the sheet of material by a plurality of perforations.

11. The packaging assembly of claim 9, wherein outer portion of the sheet of material is gathered to form at least one gathered or crimped portion a distance above the floral grouping thereby enclosing the floral grouping within the sheet of material.

12. The packaging assembly of claim 11, wherein the outer portion of the sheet of material comprises means for securing the outer portion of the sheet of material in the gathered position.

13. The packaging assembly of claim 11, wherein the securing means is selected from the group consisting of an adhesive, a cohesive, a tie, a band, a ribbon, and combinations thereof.

14. A method of packaging a floral grouping disposed in a container for transport, the method comprising the steps of:

providing a support member having an upper support surface, a lower surface, and a periphery;

disposing the lower end of the container on the upper support surface of the support member so that the container is in a non-connected relationship with respect to the support member and oriented in a substantially upright position;

wrapping a sheet of material about the support member, the container, and the floral grouping; and securing the sheet of material about the support member, the container, and the floral grouping such that the floral grouping is enclosed within and covered by the sheet of material and the container is supported in its upright position by the combination of the sheet of material and the support member so as to prevent the container and the floral grouping from toppling during transport.

15. The method of packaging of claim 14 further comprising gathering or crimping at least a portion of the sheet of material about at least a portion of the container forming a gathered or crimped portion in the sheet of material.

16. The method of packaging of claim 15 wherein the crimped or gathered portion has overlapping portions connected via a bonding material so as to secure the sheet of material about the container.

17. The method of packaging of claim 14 wherein in the securing step the sheet of material is connected to the container via a bonding material.

18. The method of packaging of claim 14, further comprising gathering an outer portion of the sheet of material a distance above the floral grouping to form at least one gathered or crimped portion thereby enclosing the floral grouping within the sheet of material.

19. A packaging assembly, comprising:

a container having an upper end, a lower end, and an outer surface and a floral grouping disposed therein;

a support member having an upper support surface, a lower surface, and a periphery, the lower end of the container bondingly connected to the upper support surface of the support member such that the container is oriented in a substantially upright position; and a sheet of material wrapped and secured about the support member and the container and the floral grouping such that the support member, the container, and the floral grouping are enclosed within and covered by the sheet of material and the container is supported in its upright position so as to prevent the container and the floral grouping from toppling during transport.

20. The packaging assembly of claim 19 wherein at least a portion of the sheet of material is secured to the container.

21. The packaging assembly of claim 19 wherein the portion of the sheet of material is gathered about the container forming a gathered or crimped portion in the sheet of material.

22. The packaging assembly of claim 20 wherein the sheet of material is secured to the container with a bonding material.

23. The packaging assembly of claim 22, wherein the bonding material is disposed on a portion of the sheet of material so as to connect at least a portion of the sheet of material to the container or to connect overlapping folds formed in the sheet of material together and thereby secure the sheet of material about the outer surface of the container.

24. The packaging assembly of claim 22, wherein the bonding material is selected from the group of cohesives, adhesives, and combinations thereof.

25. The packaging assembly of claim 22, wherein the bonding material is disposed on at least a portion of the outer surface of the container so as to connect at least a portion of the sheet of material to the outer surface of the container.

26. The packaging assembly of claim 19, wherein the support member is dimensioned such that the periphery of the support member extends radially outward a distance beyond the outer surface of the container.

27. The packaging assembly of claim 19, wherein an outer portion of the sheet of material is selectively detachable from the remaining portion of the sheet of material such that the floral grouping is exposed while the sheet of material remains secured to the container when the outer portion of the sheet of material is detached.

28. The packaging assembly of claim 27, wherein the outer portion of the sheet of material is delineated relative to the remaining portion of the sheet of material by a plurality of perforations.

29. The packaging assembly of claim 28, wherein outer portion of the sheet of material is gathered to form at least one gathered or crimped portion a distance above the floral grouping thereby enclosing the floral grouping within the sheet of material.

30. The packaging assembly of claim 29, wherein the outer portion of the sheet of material comprises means for securing the outer portion of the sheet of material in the gathered position.

31. The packaging assembly of claim 29, wherein the securing means is selected from the group consisting of an adhesive, a cohesive, a tie, a band, a ribbon, and combinations thereof.

32. A method of packaging a floral grouping disposed in a container for transport, the method comprising the steps of:

providing a support member having an upper support surface, a lower surface, and a periphery;

bondingly connecting the lower end of the container on the upper support surface of the support member such that the container is oriented in a substantially upright position;

wrapping a sheet of material about the support member, the container, and the floral grouping; and securing the sheet of material about the support member, the container, and the floral grouping such that the floral grouping is enclosed within and covered by the sheet of material and the container is supported in its upright position so as to prevent the container and the floral grouping from toppling during transport.

33. The method of packaging of claim 32 further comprising gathering or crimping at least a portion of the sheet of material about at least a portion of the container forming a gathered or crimped portion in the sheet of material.

34. The method of packaging of claim 33 wherein the crimped or gathered portion has overlapping portions connected via a bonding material so as to secure the sheet of material about the container.

35. The method of packaging of claim 32 wherein in the securing step the sheet of material is connected to the container via a bonding material.

36. The method of packaging of claim 32, further comprising gathering an outer portion of the sheet of material a distance above the floral grouping to form at least one gathered or crimped portion thereby enclosing the floral grouping within the sheet of material.

* * * * *

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 9, delete the numeral "50" and substitute therefor -- 50a --.

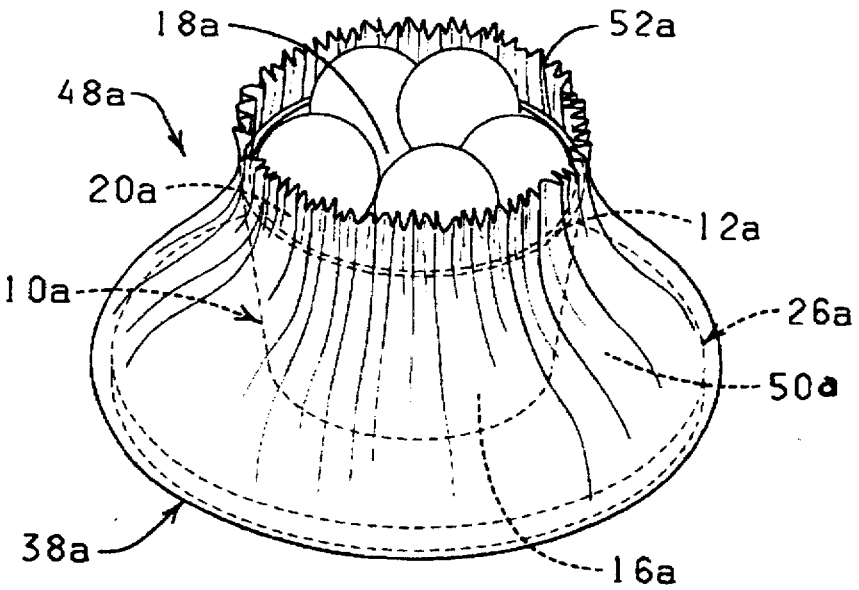

FIG. 9

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 12, delete the numerals "52" and "46" and substitute therefor, respectively -- 52b -- and -- 46b --.

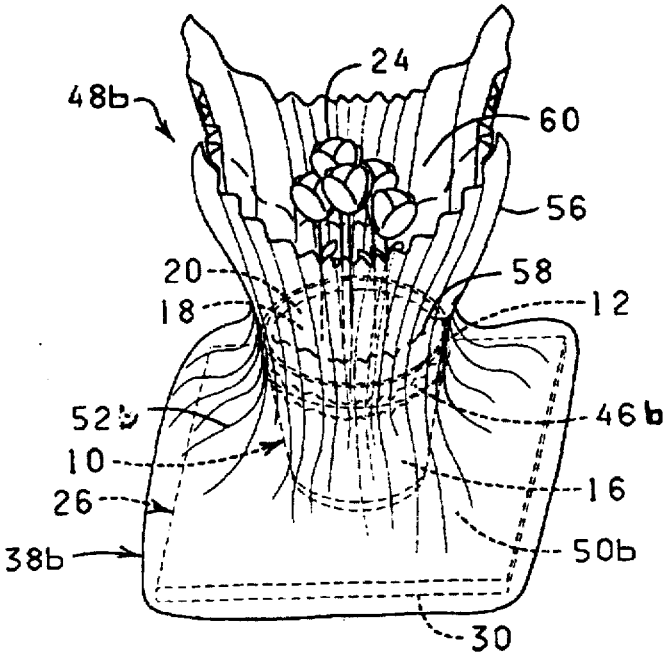

FIG. 12

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 13, delete the numeral "46" and substitute therefor -- 46c --.

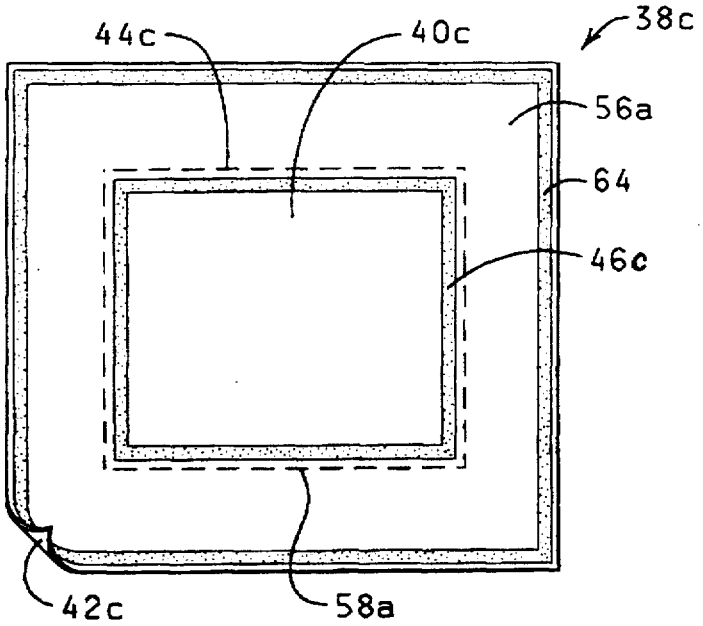

FIG. 13

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 14, delete the numeral "46" and substitute therefor -- 46c --.

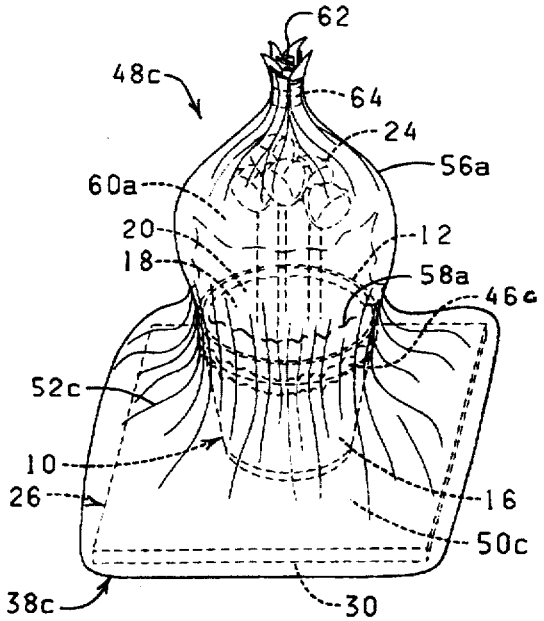

FIG. 14

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 15, delete the numeral "56d" and substitute therefor -- 56b --.

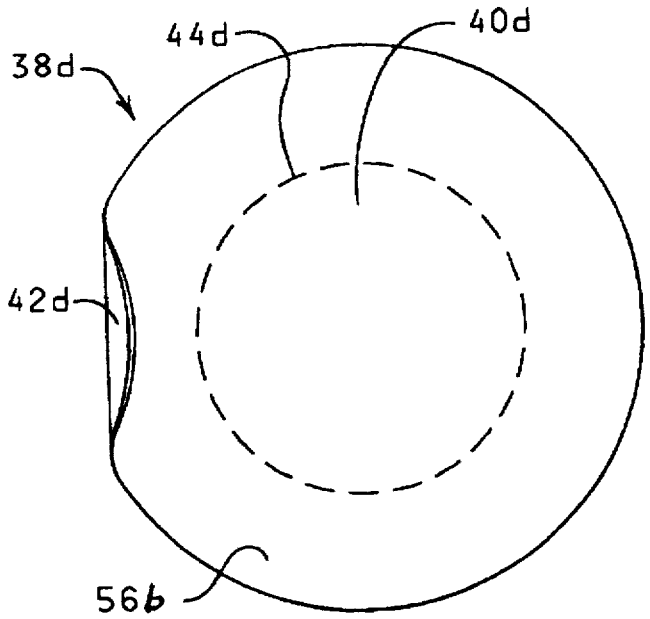

FIG. 15

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 17, delete the numeral "60d" and substitute therefor -- 60b --.

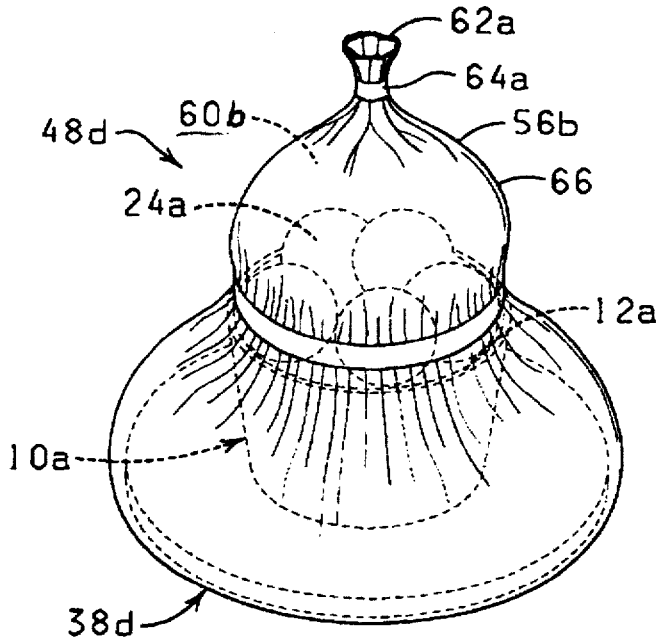

FIG. 17

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 19, add the numeral -- 46 -- and its associated lead line.

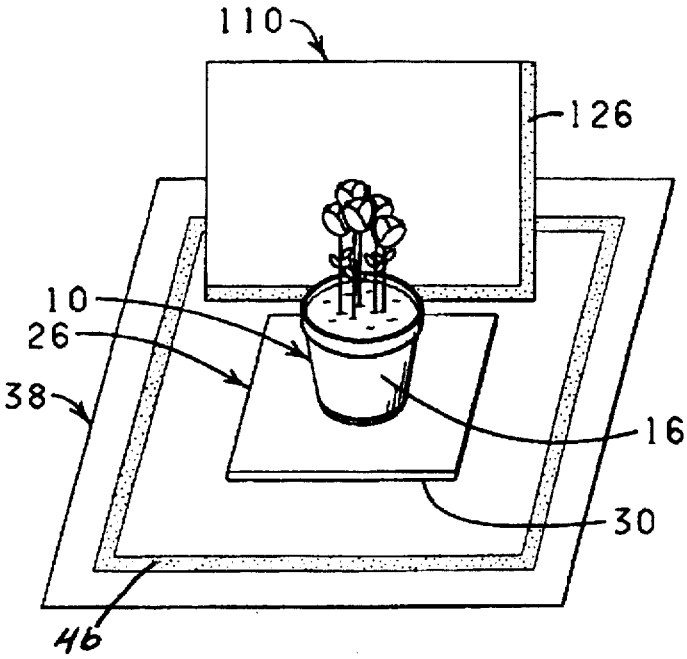

FIG. 19

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 20, add the numerals -- 46 -- and -- 12 -- and each associated lead line, and delete the numeral "50e" and substitute therefor -- 50 --.

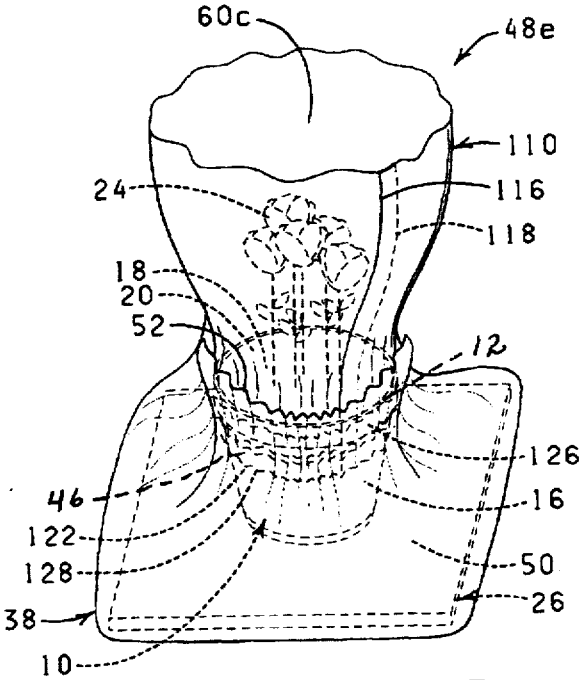

FIG. 20

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 21, delete the numeral "50f" and substitute therefor -- 50 --.

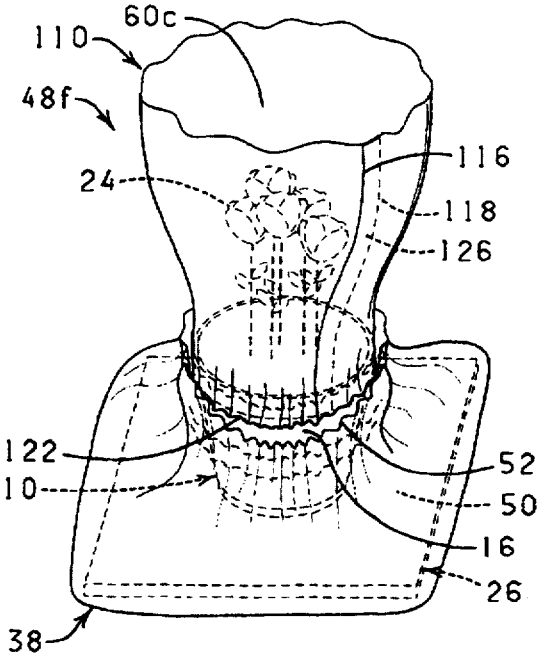

FIG. 21

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Fig. 23, delete the numeral "110g" and substitute therefor -- 110a --.

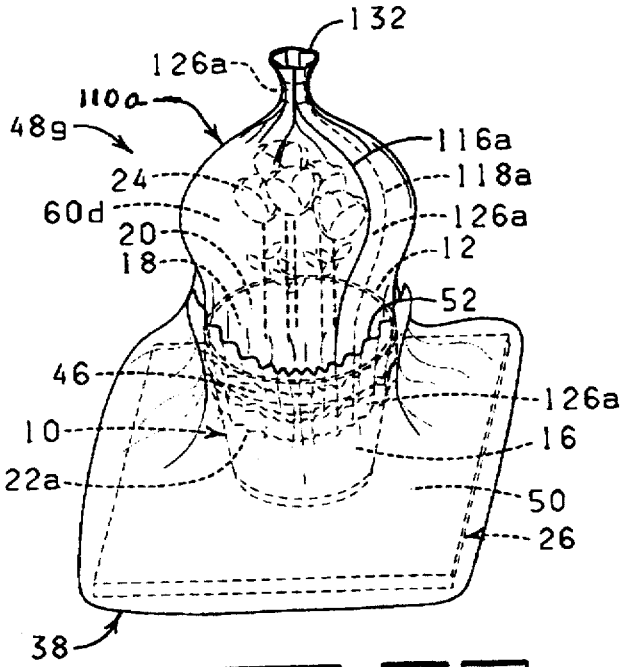

FIG. 23

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Title page,
Item [54],
Title, delete the title "PACKAGING ASSEMBLY FOR SHIPPPING A CONTAINER AND METHOD FOR USING SAME" and substitute therefor -- PACKAGING ASSEMBLY AND METHOD OF ASSEMBLING --.

Column 1,
Delete the title "PACKAGING ASSEMBLY FOR SHIPPPING A CONTAINER AND METHOD FOR USING SAME" and substitute therefor -- PACKAGING ASSEMBLY AND METHOD OF ASSEMBLING --;
Line 39, after "wherein" and before "sheet" insert -- a --;

Column 2,
Line 25, delete "the an" and substitute therefor -- the --;

Column 9,
Line 63, delete "material 38" and substitute -- material *38a* -- therefor;

Column 10,
Line 33, delete "cavity *40a*" and substitute -- cavity *50a* -- therefor;

Column 11,
Line 42, delete "container" and substitute -- flower pot 10 -- therefor;

Coumn 12,
Line 57, delete "56," and substitute therefor -- 56 --;

Column 13,
Line 48, delete "container" and substitute -- flower pot 10 -- therefor;

Column 14,
Line 16, delete "of material *38c*" and substitute -- extension *56a* -- therefor;
Line 56, delete "FIG.7" and substitute therefor -- FIG. 15 --;

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Column 15,
Line 39, delete "band 46" and substitute -- band **46*a*** -- therefor;
Line 53, after "17," and before "the" insert -- is --;

Column 16,
Line 44, delete "end 166" and substitute -- end 116 -- therefor;

Column 17,
Line 37, delete "0.2" and substitute -- 0.1 -- therefor;

Column 18,
Line 20, after "sheets" and before "may" delete "of";

Column 19,
Line 3, delete "**50*f*" and substitute -- 50** -- therefor;
Line 32, delete "**24*a*" and substitute -- 24** -- therefor;
Line 34, after "flower pot" insert -- 10 --;

Column 20,
Line 8, delete "**25*a*" and substitute -- 26*a*** -- therefor;
Line 44, delete "**128*b*" and substitute -- 128*a*** -- therefor;
Line 45, delete "**110*a*," and substitute therefor -- 110*b*,** -- therefor;
Line 46, delete "extension," and substitute -- extension **110*b*,** -- therefor;
Line 48, delete "**110*a*" and substitute -- 110*b*** -- therefor;
Line 52,delete "**110*a*" (both occurrences) and substitute therefor (both occurrences) -- 110*b*** -- ;
Line 54,delete "**110*a*" and substitute -- 110*b*** -- therefor;
Line 58, delete "ends" and substitute therefor -- end, --; and

UNITED STATES PATENT AND TRADEMARK OFFICE

CERTIFICATE OF CORRECTION

PATENT NO. : 5,836,447
DATED : November 17, 1998
INVENTOR(S) : Pedro F. Garcia et al.

It is certified that error appears in the above-identified patent and that said Letters Patent is hereby corrected as shown below:

Column 21,
Line 1 of claim 11, after "wherein" and before "outer" insert -- the --.

Signed and Sealed this

Fourth Day of December, 2001

*Attest:*

Nicholas P. Godici

NICHOLAS P. GODICI
*Acting Director of the United States Patent and Trademark Office*

*Attesting Officer*